US012128526B2

(12) United States Patent
Sventek et al.

(10) Patent No.: US 12,128,526 B2
(45) Date of Patent: Oct. 29, 2024

(54) CONFORMABLE ABRASIVE ARTICLE

(71) Applicant: 3M INNOVATIVE PROPERTIES COMPANY, St. Paul, MN (US)

(72) Inventors: Bruce A. Sventek, Woodbury, MN (US); Stephen C. Loper, Eden Prairie, MN (US); Samad Javid, Woodbury, MN (US); David G. Baird, Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 884 days.

(21) Appl. No.: 17/051,861

(22) PCT Filed: Apr. 29, 2019

(86) PCT No.: PCT/IB2019/053483
§ 371 (c)(1),
(2) Date: Oct. 30, 2020

(87) PCT Pub. No.: WO2019/211719
PCT Pub. Date: Nov. 7, 2019

(65) Prior Publication Data

US 2021/0114171 A1 Apr. 22, 2021

Related U.S. Application Data

(60) Provisional application No. 62/665,065, filed on May 1, 2018.

(51) Int. Cl.
*B24D 11/00* (2006.01)
*B24B 1/00* (2006.01)
(Continued)

(52) U.S. Cl.
CPC ..... *B24D 11/003* (2013.01); *B24B 1/002* (2013.01); *B24B 27/033* (2013.01);
(Continued)

(58) Field of Classification Search
None
See application file for complete search history.

(56) References Cited

U.S. PATENT DOCUMENTS 4,945,687 A 8/1990 Scheider
5,152,917 A 10/1992 Pieper
(Continued)

FOREIGN PATENT DOCUMENTS

GB 1189561 4/1970
JP 7195275 A 1/1995
(Continued)

OTHER PUBLICATIONS

International Search report for PCT International Application No. PCT/IB2019/053483 mailed on Sep. 13, 2019, 4 pages.

*Primary Examiner* — Alexandra M Moore
(74) *Attorney, Agent, or Firm* — Jonathan L. Tolstedt

(57) ABSTRACT

The present disclosure provides abrasive articles that include an abrasive layer having a contact surface, a first layer coupled to the abrasive layer, and a second layer coupled to the first layer. The first layer is configured to provide contact pressure to the abrasive layer, such as through a higher hardness than the second layer. The second layer is configured to provide conformability to the abrasive layer, such as through a higher compressibility than the first layer. The resulting abrasive articles may exert a consistent contact pressure against a substrate with increased conformability around the substrate, reduced hysteresis, improved removal rate consistency, and/or improved lifetime over abrasive articles that do not use the multiple layer construction described above.

6 Claims, 10 Drawing Sheets

(51) Int. Cl.
*B24B 27/033* (2006.01)
*B24B 41/047* (2006.01)
*B24D 11/02* (2006.01)

(52) U.S. Cl.
CPC ..... *B24B 41/047* (2013.01); *B24D 11/008* (2013.01); *B24D 11/02* (2013.01)

(56) References Cited

U.S. PATENT DOCUMENTS

| | | | | |
|---|---|---|---|---|
| 5,206,992 | A | 5/1993 | Carlson | |
| 5,238,970 | A | 8/1993 | De Vos | |
| 6,580,006 | B1 | 6/2003 | Lamanna | |
| 7,087,788 | B2 | 8/2006 | Sievert | |
| 9,630,290 | B2 | 4/2017 | Venkatachalam | |
| 2004/0020789 | A1* | 2/2004 | Hu | H01L 21/32125 205/666 |
| 2007/0173176 | A1 | 7/2007 | Kiontke | |
| 2008/0233837 | A1 | 9/2008 | Annen | |
| 2012/0156972 | A1 | 6/2012 | Brown | |
| 2013/0252514 | A1 | 9/2013 | Wilson | |
| 2017/0106501 | A1 | 4/2017 | Baratti | |
| 2017/0203408 | A1 | 7/2017 | Ganapathiappan | |

FOREIGN PATENT DOCUMENTS

| | | | |
|---|---|---|---|
| JP | 2006326795 | A | 12/2006 |
| WO | WO 2013-003566 | | 1/2013 |

* cited by examiner

CONFORMABLE ABRASIVE ARTICLE

CROSS REFERENCE TO RELATED APPLICATIONS

This application is a national stage filing under 35 U.S.C. 371 of PCT/IB2019/053483, filed 29 Apr. 2019, which claims the benefit of Provisional Application No. 62/665,065, filed 1 May 2018, the disclosure of which is incorporated by reference in their entirety herein.

TECHNICAL FIELD

The invention relates to abrasives and abrasive tools.

BACKGROUND

Handheld electronics, such as touchscreen smartphones and tablets, often include a cover glass to provide durability and optical clarity for the devices. Production of cover glasses may use computer numerical control (CNC) machining for consistency of features in each cover glass and high-volume production. The edge finishing of the perimeter of a cover glass is important for strength and cosmetic appearance. Typically, diamond abrasive tools, such as metal bonded diamond tools, are used to machine the cover glasses. These tools may last a relatively long time and may be effective at high cutting rates. However, the tools may leave microcracks in the cover glass that become stress concentration points, which may significantly reduce the strength of the glass. To improve the strength or appearance of the cover glasses, the edges may be polished. For example, a polishing slurry, such as cerium oxide, is typically used to polish the glass covers. However, slurry-based polishing may be slow and require multiple polishing steps. Additionally, slurry polishing equipment may be large, expensive, and unique to particular features being polished. Overall, the slurry polishing systems themselves may produce low yields, create rounded corners of the substrate being abraded and increase labor requirements.

SUMMARY

The disclosure is generally directed to abrasive articles with improved contact force and contact length control on a substrate. Example abrasive articles include an abrasive layer having a contact surface, a first layer coupled to the abrasive layer, and a second layer coupled to the first layer. The first layer is generally configured to provide contact pressure to the abrasive layer against a substrate, such as through a higher hardness than the second layer. The second layer is generally configured to provide conformability of the abrasive layer to a substrate, such as through a higher compressibility than the first layer. The resulting abrasive articles may exert a consistent contact pressure against a substrate with increased conformability around the substrate, reduced hysteresis, improved removal rate consistency, and/or improved lifetime compared to abrasive articles that do not use the multiple layer construction described above.

In one embodiment, an abrasive article includes an abrasive layer, a first layer coupled to the abrasive layer, and a second layer coupled to the first layer. The abrasive layer has a contact surface. The first layer has a Shore A hardness (e.g., as measured using ASTM D2240) of no greater than 80. The second layer has a Shore A hardness that is less than the Shore A hardness of the first layer.

In another embodiment, an abrasive article includes an abrasive layer having a contact surface; a first layer coupled to the abrasive layer; and a second layer coupled to the first layer, wherein the second layer has a compressibility at 25% deflection of no greater than 1.5 MPa and the compressibility at 25% deflection of the first layer is greater than the compressibility at 25% deflection of the second layer.

In some embodiments, an abrasive rotary tool includes a tool shank and either abrasive article described above coupled to the tool shank. The tool shank defines an axis of rotation for the rotary tool. The contact surface of the abrasive article faces away from the tool shank.

In some embodiments, an assembly includes a computer-controlled machining system that includes an abrasive rotary tool, a computer-controlled rotary tool holder, and a substrate platform. A substrate is secured to the substrate platform. The abrasive rotary tool includes either abrasive article described above.

In another embodiment, the present disclosure provides a method for abrading a substrate includes providing a computer-controlled machining system including a computer controlled rotary tool holder and a substrate platform. The method further includes securing the abrasive rotary tool described above to the rotary tool holder of the computer-controlled machining system. The method further includes providing a substrate having a first major surface, a second major surface, and an edge surface. The edge surface intersects the first major surface to form a first corner and intersects the second major surface to form a second corner. The method further includes operating the computer-controlled machining system to abrade the edge and at least one of a portion of the first corner and a portion of the second corner of the substrate with the abrasive layer of the abrasive rotary tool. In some embodiments, the abrasive layer of the abrasive rotary tool simultaneously abrades the edge and at least one of a portion of the first corner and a portion of the first major surface, and a portion of the second corner and a portion of second major surface.

The details of one or more embodiments of the disclosure are set forth in the accompanying drawings and the description below. Other features, objects, and advantages of the invention will be apparent from the description and drawings, and from the claims.

BRIEF DESCRIPTION OF DRAWINGS

Like symbols in the drawings indicate like elements. Dotted lines indicate optional or functional components, while dashed lines indicate components out of view.

DETAILED DESCRIPTION

The present disclosure describes abrasive articles with improved removal, removal rate consistency and lifetime.

Often, an abrasive tool may be used to abrade different components and/or different surfaces of a component. An abrasive tool with one or more compressible backing layers may not provide enough contact pressure to remove topology variations on one or more substrate surfaces. Also, compressible materials often exhibit stress relaxation during deformation due to their time-dependent viscoelastic nature which could cause inconsistent abrading. On the other hand, an abrasive tool with at least one harder backing layer may exhibit high hysteresis, lower conformability, and/or high variation in application of force, which may also cause inconsistent abrading.

As discussed herein, abrasive articles of the present disclosure may be more conformable to the surface of the substrate and provide a more consistent contact pressure for a more consistent removal and removal rate with less wear of the abrasive article. In one embodiment, an abrasive article includes an abrasive layer, a first layer coupled to the abrasive layer, and a second layer coupled to the first layer. The abrasive layer is configured to contact a substrate and remove material from the substrate. The first layer may be configured to provide a consistent contact pressure for the abrasive layer against the substrate, such as through a material having a relatively high hardness, low compressibility, low stress relaxation and/or low thickness. The second layer may be a compressible layer generally configured to conform the abrasive layer against a substrate, such as a material having a relatively low hardness, high compressibility, and/or high thickness. The combination of the consistent contact pressure generally provided by the first layer and the conformability generally provided by the second layer may enable the abrasive layer to more consistently remove material from the substrate and may extend the life of the abrasive article.

Figure 1A:
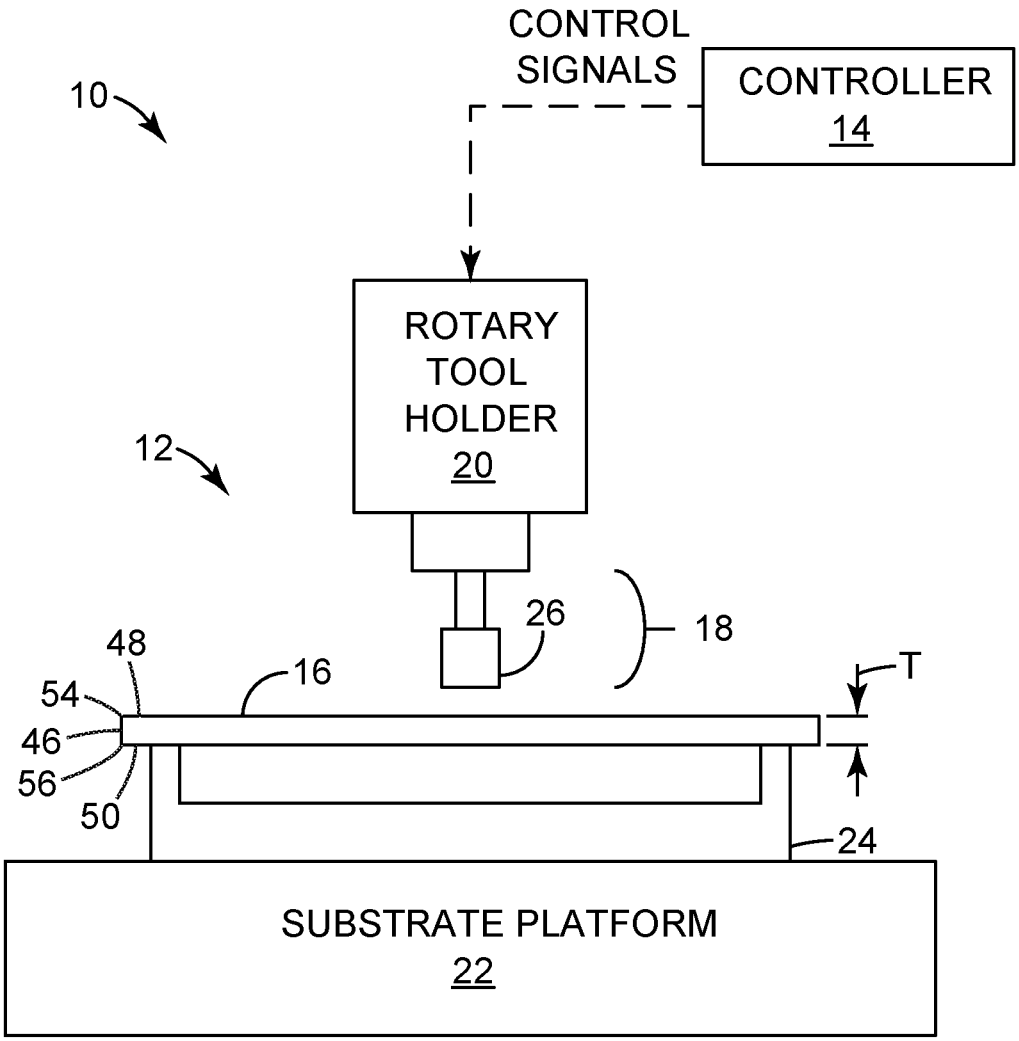
FIG. 1A illustrates an assembly for abrading a substrate.

FIG. 1A illustrates an assembly 10, which includes a computer-controlled machining system 12 and a machining system controller 14. Controller 14 is configured to send control signals to machining system 12 for causing machining system 12 to machine, grind, or abrade a substrate 16 with a rotary tool 18, which is mounted within a rotary tool holder 20 of machining system 12. In one embodiment, machining system 12 may represent a CNC machine, such as a three, four, or five axis CNC machine, capable of performing routing, turning, drilling, milling, grinding, abrading, and/or other machining operations, and controller 14 may include a CNC controller that issues instructions to rotary tool holder 20 for performing machining, grinding, and/or abrading of substrate 16 with one or more rotary tools 18. Controller 14 may include a general purpose computer running software, and such a computer may combine with a CNC controller to provide the functionality of controller 14.

Substrate 16 is mounted and secured to substrate platform 22 in a manner that facilitates precise machining of substrate 16 by machining system 12. Substrate holding fixture 24 secures substrate 16 to substrate platform 22 and precisely locates substrate 16 relative to machining system 12. Substrate holding fixture 24 may also provide a reference location for control programs of machining system 12. While the techniques disclosed herein may apply to workpieces of any materials, substrate 16 may be a component for an electronic device. In some embodiments, substrate 16 may be a transparent display element of an electronic device, such as a cover glass for an electronic device or, more particularly, a cover glass of a smartphone touchscreen.

In some embodiments, substrate 16 may include a first major surface 48 (e.g. a top of substrate 16), a second major surface 50 (e.g. a bottom of substrate 16), and one or more edge surfaces 46 (e.g. sides of substrate 16). The area of the edge surface of the substrate is typically less than the area of the first major surface and/or second major surface of the substrate. In some embodiment, the ratio of the edge surface of the substrate to the area of the first major surface of the substrate and/or the ratio of the edge surface of the substrate to the area of the second major surface of the substrate may be greater than 0.00001, greater than 0.0001, greater than 0.0005, greater than 0.001, greater than 0.005 or even greater than 0.01; less than 0.1, less than 0.05 or even less than 0.02. In some embodiments, the thickness, T, of the edge surface measured normal to the first and/or second major surfaces is no greater than 5 mm, no greater than 4 mm, no greater than 3 mm, no greater than 2 mm or even no greater than 1 mm. The edge surface intersects the first major surface to form a first corner 54 and intersects the second major surface to form the second corner 56. In some embodiments, the edge surface may be substantially perpendicular to each of the major surfaces. As used herein, "corner" may represent any surface, edge, or other change in plane between the edge surface of substrate 16 and either of the first major surface and the second major surface of substrate 16. For example, the first and/or second corner may be a sharp edge (e.g., having a radius of curvature substantially less than the thickness of the edge surface), a planar surface, a curved corner, multiple surfaces, a chamfered corner, or any combination thereof. During abrading of substrate 16, the first and second corners may start as sharp edges or small surfaces that increase in curvature and/or surface area as material is removed during abrading. Further embodiments of substrate 16 will be described in FIGS. 1C, 3, 4B, and 5B below.

In the embodiment of FIG. 1A, rotary tool 18 is illustrated as including an abrasive article 26. In this embodiment, abrasive article 26 may be utilized to improve the surface finish of machined features of substrate 16, such as holes and edge features in a cover glass. In some embodiments, different rotary tools 18 may be used in series to iteratively improve the surface finish of the machined features. For example, assembly 10 may be utilized to provide a coarser grinding step using a first rotary tool 18, or a set of rotary tools 18, followed by a finer abrading step using a second rotary tool 18, or a set of rotary tools 18. In some embodiments, a single rotary tool 18 may include different levels of abrasion to facilitate an iterative grinding and/or abrading process using fewer rotary tools 18. Each of these embodiments may reduce the cycle time for finishing and polishing a substrate following the machining of the features of the substrate as compared to other embodiments in which only a single grinding step is used to improve surface finish following machining of features in a substrate. In some embodiments, the substrate may remain secured to substrate holding fixture 24 throughout the iterations of the different rotary tools 18.

In some embodiments, following grinding and/or abrading using assembly 10, a substrate may be polished, e.g., using a separate polishing system to further improve the surface finish. In general, the better the surface finish prior to polishing, the less time is required to provide a desired surface finish following the polishing. To abrade an edge of substrate 16 with assembly 10, controller 14 may issue instructions to rotary tool holder 20 to precisely apply abrasive article 26 against one or more features of substrate 16 as rotary tool holder 20 rotates rotary tool 18. The instructions may include for example, instructions to precisely follow the contours of features of substrate 16 with a single abrasive article 26 of rotary tool 18 as well as iteratively apply multiple abrasive articles 26 of one or more rotary tools 18 to different features of substrate 16.

Figure 1B:
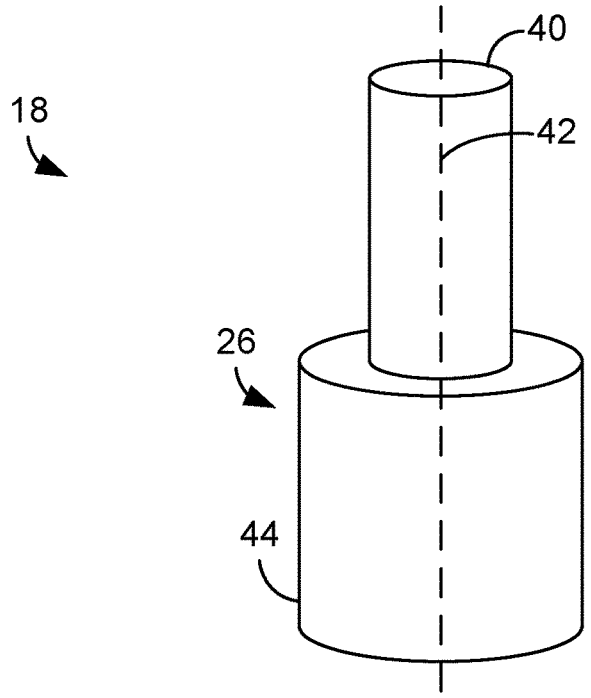
FIG. 1B illustrates a rotary tool for abrading a substrate.

FIG. 1B illustrates rotary tool 18, which includes a tool shank 40 and abrasive article 26. Tool shank 40 defines an axis of rotation 42 for rotary tool 18. Abrasive article 26 is coupled to tool shank 40. Abrasive article 26 includes an abrasive layer having a contact surface 44 facing away from tool shank 40. In some embodiments, a plane of contact surface 44 may be substantially parallel (e.g., within 5 degrees) to axis of rotation 42. In some embodiments (not shown in FIG. 1B), an included angle between the plane of contact surface 44 and axis of rotation 42 may be between 5 degrees and 90 degrees, 5 degrees and 85 degrees, 5 degrees and 80 degrees or even 5 degrees and 70 degrees.

Figure 1C:
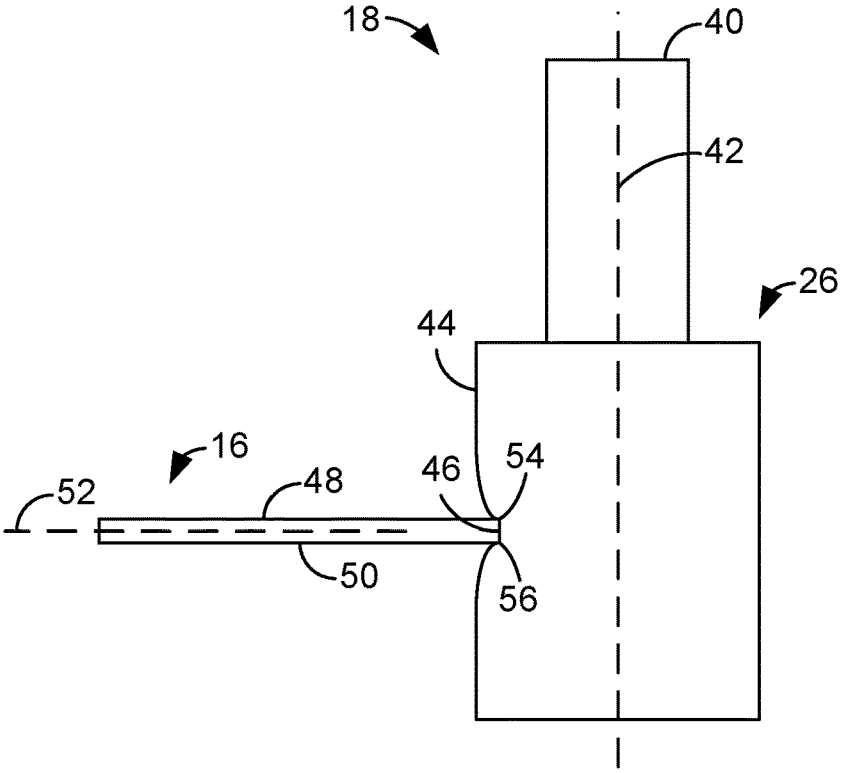
FIG. 1C illustrates a rotary tool abrading a substrate.

FIG. 1C illustrates rotary tool 18 abrading substrate 16. Substrate 16 includes a first major surface 48, a second major surface 50 opposite first major surface 48, and an edge surface 46. Edge surface 46 intersects first major surface 48 to form a first corner 54 and intersects second major surface 50 to form a second corner 56. In some embodiments, at least one of the first corner and the second corner includes at least one of a chamfered corner and a curved corner.

Rotary tool 18 rotates around axis of rotation 42, causing contact surface 44 to contact substrate 16 at edge surface 46, and optionally at least one of first corner 54 and second corner 56, and optionally, at least one of first and second major surfaces 48, 50. Rotary tool 18 may exert a contact pressure on edge 46 of substrate 16, such that contact surface 44 is deformed against substrate 16 and contacts edge surface 46 and at least one of the first and second corners. As contact surface 44 contacts edge surface 46 and either or both of the first and second corners, contact surface 44 removes material from the edge surface 46 and either or both of the first and second corners.

In accordance with embodiments discussed herein, abrasive article 26 is configured to conform to at least one edge of substrate 16 and apply a consistent contact pressure against one or more surfaces of the edge of substrate 16 over a period of time. As will be described further in FIG. 2, abrasive article 26 includes an abrasive layer, a first layer coupled to the abrasive layer, and a second layer coupled to the first layer. The abrasive layer may be configured to contact substrate 16 and remove material from substrate 16. The first layer may be a layer configured to generally provide a consistent contact pressure for the abrasive layer against substrate 16. The second layer may be a compressible layer configured to generally conform the abrasive layer against substrate 16. The combination of the consistent contact pressure provided by the first layer and the conformability provided by the second layer may cause the abrasive layer to more consistently remove material from substrate 16 and may extend the life of abrasive article 26.

Figure 2:
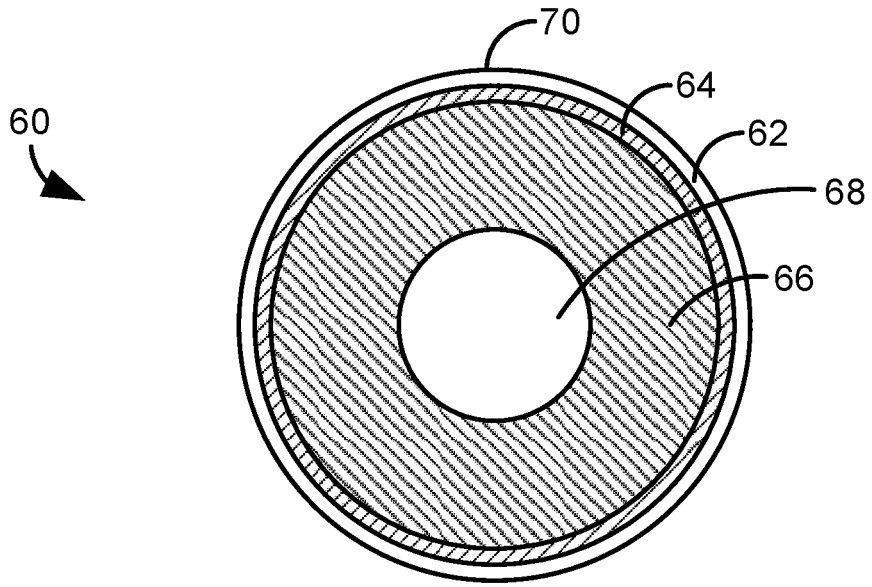
FIG. 2 illustrates a top view cross-sectional diagram of an abrasive article for abrading a substrate.

FIG. 2 illustrates a top view cross-sectional diagram of an abrasive article 60 for abrading a substrate. Abrasive article 60 may be used, for example, as abrasive article 26 of FIGS. 1A-C. Abrasive article 60 includes an abrasive layer 62, a first layer 64 coupled to abrasive layer 62, a second layer 66 coupled to first layer 64, and a core region 68 surrounded by second layer 66. Core region 68 may include, for example, a tool shank such as tool shank 40 of FIGS. 1B and 1C, or a surface for attaching a tool shank. Abrasive layer 62 includes contact surface 70.

In the embodiment of FIG. 2, first layer 64 is coupled to a surface of abrasive layer 62 opposite contact surface 70. In some embodiments, an optional first adhesive layer is disposed between abrasive layer 62 and first layer 64. Second layer 66 is disposed between first layer 66 and core region 68 and may be coupled to one or both of a surface of first layer 64 (opposite abrasive layer 62) and a surface of a tool shank in core region 68. In some embodiments, an optional second adhesive layer is disposed between first layer 64 and second layer 66. In some embodiments, an optional third adhesive layer is disposed between first second layer 66 and core region 68. In one embodiment, abrasive article 60 may be assembled as a multilayered sheet, such as by providing a second layer 66, depositing first layer 64 on second layer 66, and depositing abrasive layer 62 on first layer 64. The multilayered sheet may be cut and adhered to core region 68, such as a tool shank.

First layer 64 and second layer 66 may be configured to provide a more consistent contact pressure and higher conformability to contact surface 70 of abrasive layer 62 than abrasive articles that do not include the features of first layer 64 and second layer 66, as will be explained further below. As such, various properties and configurations of the materials of first layer 64 and second layer 66 may be selected to improve contact pressure consistency and conformability of contact surface 70 against a substrate. As will be explained below, properties of first layer 64 and second layer 66 may include, but are not limited to, softness, hardness, compressibility, relaxation modulus (e.g. stress relaxation modulus), thickness, and other properties that may affect the contact pressure and conformability of each of first layer 64 and/or second layer 66.

Without being limited to any particular theory, in some embodiments, first layer 64 may be selected primarily to provide a high contact pressure for abrasive layer 62 at contact surface 70 against a substrate, while second layer 66 may be selected primarily to provide high conformability for abrasive layer 62 against the substrate. For example, contact pressure may be realized as a more concentrated property, such that a material favorable to high contact pressure may be advantageously located near a surface of abrasive layer 62, as in first layer 64. On the other hand, conformability may be realized as a more distributed property, such that a material conducive to high conformability may be advantageously located away from abrasive layer 62, as in second layer 66. In this configuration, first layer 64 may provide a high contact pressure, and corresponding high removal rate, near to contact surface 70, while second layer 66 may support first layer 64 by providing high conformability, and corresponding higher contact length, of contact surface 70 against a substrate and a more consistent application of contact pressure from contact surface 70 due at least in part to the higher conformability of abrasive article 60. As explained above, the use of both first layer 64 and second layer 66 enables abrasive article 60 to provide a consistent contact pressure to contact surface 70 of abrasive layer 62. This enables the abrasive layer to uniformly abrade material from non-planar surfaces of substrates (e.g. a substrate corner), which otherwise could not be able to accomplish. In some embodiments, first layer 64 and second layer 66 may each include multi-layered themselves.

First layer 64 and second layer 66 may each be composed of a material selected according to softness. Softness of a material may be correlated with contact pressure and conformability of the material; generally, a softer material may have a lower contact pressure and a higher conformability. Softness may be represented by and selected based on a variety of properties of each material of first layer 64 and second layer 66. For example, a softer material may be a material with a lower hardness (as indicated using any appropriate hardness scale, such as Shore A or Shore OO), a material with a lower elastic modulus, a material with a higher compressibility (typically quantified via a material's Poisson's ratio or deflection), or a material with a modified structure, such as containing a plurality of gas inclusions such as a foam, containing an engraved structure, etc. In some embodiments, the material of second layer 66 may be softer than the material of first layer 64. For example, an identical compressive force applied to an identically sized block of each material of first layer 64 and second layer 66 may result in a larger deformation in the direction of applied force for the softer material of second layer 66 than the harder material of first layer 64.

In some embodiments, first layer 64 and second layer 66 may each be composed of a material selected according to hardness. Hardness may represent a measure of each of first layer 64 and second layer 66 to deform in response to a force. In some cases, the hardness may be most appropriately measured using different scales for the first layer and second layer (e.g., Shore A durometer for the first layer and Shore OO for the layer).

In some embodiments, the hardness, such as the Shore A hardness, of second layer 66 is less than the hardness of first layer 64. For example, when first layer 64 includes a material having a hardness of 60 Shore A durometer (e.g., as measured using ASTM D2240), then the hardness of second layer 66 may be less than 60 Shore A durometer. In some embodiments, first layer 64 may have a hardness that is greater than 30 Shore A and less than about 80 Shore A, or greater than about 40 Shore A and less than about 70 Shore A. In some embodiments, second layer 66 may have a hardness that is less than about 50 Shore A, or less than about 20 Shore A, or less than about 10 Shore A. In some embodiments, the hardness of each of first layer 64 and second layer 66 may be expressed relative to each other, such as a particular ratio of hardness of second layer 66 to first layer 64. For example, a ratio of the Shore A hardness of first layer 64 to the Shore A hardness of second layer 66 is greater than 1 and less than 8 or even greater than 2 and less than 7.

In some embodiments, first layer 64 and second layer 66 may each be composed of a material selected according to compressibility. Compressibility may represent a measure of the relative change of a material of each of first layer 64 and second layer 66 in response to a pressure, while the terms "compressible" or "incompressible" may refer to a material property of compressibility. For example, the term "substantially incompressible" refers to a material having a Poisson's ratio greater than about 0.45. Compressibility of a material may be expressed as a particular pressure required to compress the material to a reference deflection (e.g., 25% deflection). In some embodiments, the compressibility of the layer may be measured via Compression Force Deflection Testing per ASTM D3574 or a modified version thereof, when the layer is foam; and via Compression-Deflection Testing per ASTM D1056 when the layer is a flexible cellular material such as, for example, sponge or expandable rubber.

In some embodiments, the compressibility of second layer 66 is less than the compressibility of first layer 64. For example, second layer 66 may have a compressibility at 25% deflection less than the compressibility at 25% deflection of first layer 64. In some embodiments, the Poisson's ratio of second layer 66 is less than the Poisson's ratio of first layer 64. In some embodiments, second layer 66 may have a compressibility at 25% deflection of less than about 1.5 MPa (220 psi), less than about 1.1 MPa (160 psi), less than about 0.31 MPa (45 psi) and/or a Poisson's ratio less than about 0.5, less than about 0.4, less than 0.3 or preferably less than about 0.1. In some embodiments, the compressibility of the material of each of first layer 64 and second layer 66 may be expressed relative to each other, such as a particular ratio of compressibility of first layer 64 to second layer 66. For example, a ratio of the compressibility at 25% deflection of the first layer to the compressibility at 25% deflection of the second layer is greater than 1 and less than 200, optionally, less 150, less than 100, less than 50, less than 20 or even less than 10 or even greater than 2 and less than 200, optionally, less 150, less than 100, less than 50, less than 20 or even less than 10.

In some embodiments, first layer 64 may be substantially incompressible, e.g., the relative volume change of the material in response to a contact pressure is less than 5%, less than 2%, less than 1%, less than 0.5%, or less than 0.2%. In some embodiments, second layer 66 may be substantially incompressible, but sufficiently soft to provide the desired conformability. In some embodiments, second layer 66 may be a layer made of substantially incompressible material which has been patterned, 3D printed, embossed, or engraved to provide the desired conformability.

In some embodiments, second layer 66 may be composed of a material selected according to elastic deformation. Elastic deformation may represent an ability of a material of second layer 66 to recover to its original state after being deformed. The material of second layer 66 may be elastically deformable, e.g., being capable of substantially 100% (e.g., 90% or more, 95% or more, 99% or more, 99.5% or more, or 99.9% or more) recovering to its original state after being deformed. In some embodiments, second layer 66 may be compressible to provide the desired conformability. In some embodiments, first layer 64 and second layer 66 may each be composed of a material selected according to relaxation modulus, e.g. stress relaxation modulus. Relaxation modulus may represent a measure of a time-dependent viscoelastic property. In this disclosure, relaxation modulus is expressed in percentage and is determined from the relaxation modulus versus time curve provided from a stress relaxation test (e.g., as measured using ASTM D6048) using the following equation:

Relaxation modulus (%)=(instantaneous modulus-modulus after 2 minutes relaxation under a constant compressive strain)/instantaneous modulus×100.

In some embodiments, at least one of first layer 64 and second layer 66 has a relaxation modulus of less than 25%.

In some embodiments, first layer 64 and/or second layer 66 may be configured for various thicknesses. In the embodiment of FIG. 2, first layer 64 has a first thickness and second layer 64 has a second thickness that is greater than the first thickness. In some embodiments, the first thickness of first layer 64 may be less than 3 mm. In some embodiments, the first thickness of first layer 64 is in a range from about 0.005 inch (0.125 mm) to about 0.300 inch (7.5 mm), or preferably from about 0.005 inch (0.125 mm) to about 0.080 inch (2 mm). In some embodiments, the first thickness of first layer 64 and the second thickness of second layer 66 may be selected according to a relative thickness, such as a ratio of the first thickness to the second thickness. In some embodiments, the ratio of the first thickness to the second thickness is less than 0.75. In some embodiments, the ratio of the second thickness of second layer 66 to the first thickness of first layer 64 may be about 3:1 or greater, about 5:1 or greater, about 7:1 or greater, or about 10:1 or greater. In some embodiments, the ratio of the second thickness of second layer 66 to the first thickness of first layer 64 may be less than 100/1, less than 50/1 or even less than 20/1. First layer 64 may be formed from a variety of materials having one or more properties discussed above. In some embodiments, first layer 64 includes at least one of an elastomer, a fabric, or a nonwoven material. Suitable elastomers may include thermoset elastomers such as, for example, nitriles, fluoroelastomers, chloroprenes, epichlorohydrins, silicones, urethanes, polyacrylates, EPDM (ethylene propylene diene monomer) rubbers, SBR (styrenebutadiene rubber), butyl rubbers, nylon, polystyrene, polyethylene, polypropylene, polyester, polyurethane, etc. In some embodiment, the density of the first layer may be greater than 0.8 g/cm$^3$, greater than 0.85 g/cm$^3$, greater than 0.9 g/cm$^3$, greater than 0.95 g/cm$^3$, greater than 1.0 g/cm$^3$, greater than 1.1 g/cm3 or even greater than 1.2 g/cm$^3$; less than 2.0 g/cm$^3$, less than 1.8 g/cm$^3$, less than 1.6 g/cm$^3$, less than 1.4 g/cm3 or even less than 1.2 g/cm$^3$.

Second layer 66 may be formed from a variety of materials having one or more properties discussed above. In some embodiments, second layer 66 includes one of a foam, an engraved, structured, 3D printed, or embossed elastomer, a fabric or nonwoven layer, or a rubber having a Shore A hardness less than 50. A suitable foam may be open-celled or closed-celled, including, for example, synthetic or natural foams, thermoformed foams, polyurethanes, polyesters, polyethers, filled or grafted polyethers, viscoelastic foams, melamine foam, polyethylenes, cross-linked polyethylenes, polypropylenes, silicone, ionomeric foams, etc. The second layer may also include foamed elastomers, vulcanized rubbers, including, for example, isoprene, neoprene, polybutadiene, polyisoprene, polychloroprene, natural rubber, nitrile rubber, polyvinyl chloride and nitrile rubber, ethylene-propylene copolymers such as EPDM (ethylene propylene diene monomer), and butyl rubber (e.g., isobutylene-isoprene copolymer). In some embodiments, second layer 66 may include various compressible structures. For example, second layer 66 may include any suitable compressible structures such as, for example, springs, nonwovens, fabrics, air bladders, etc. In some embodiments, second layer 66 may be 3D printed to provide desired Poisson's ratio, compressibility, and elastic response. In some embodiment, the density of the second layer may be greater than 0.2 g/cm$^3$, greater than 0.25 g/cm$^3$, greater than 0.3 g/cm$^3$, greater than 0.35 g/cm$^3$, greater than 0.4 g/cm$^3$, greater than 0.45 g/cm3 or even greater than 0.50 g/cm$^3$; less than 1.2 g/cm$^3$, less than 1.0 g/cm$^3$, less than 0.95 g/cm$^3$, less than 0.90 g/cm$^3$, less than 0.85 g/cm$^3$, less than 0.80 g/cm$^3$, less than 0.75 g/cm$^3$, or even less than 0.70 g/cm$^3$. In some embodiments the density of the first layer is greater than the density of the second layer.

Abrasive layer 62 includes contact surface 70. Contact surface 70 is configured to contact and abrade one or more surfaces of a substrate. Abrading may include grinding, polishing, and any other action that removes material from the substrate. As will be appreciated by those skilled in the art, abrasive layer 62 along with contact surface 70 can be formed according to a variety of methods including, e.g., molding, extruding, embossing, and combinations thereof.

Abrasive layer 62 may include a base layer, e.g. backing layer, and a contact layer. The base layer may be formed from a polymeric material. For example, the base layer may be formed from thermoplastics, such as polypropylene, polyethylene, polyethylene terephthalate and the like; thermosets, such as polyurethanes, epoxy resin, and the like; or any combinations thereof. The base layer may include any number of layers. The thickness of the base layer (i.e., the dimension of the base layer in a direction normal to the first and second major surfaces) may be less than 10 mm, less than 5 mm, less than 1 mm, less than 0.5 mm, less than 0.25 mm, less than 0.125 mm, or less than 0.05 mm.

In some embodiments, contact surface 70 of abrasive layer 62 includes a microstructured surface. The microstructured surface may include microstructures configured to increase a contact pressure of contact surface 70 on one or more surfaces of a substrate. In some embodiments, the microstructured surface may include a plurality of cavities interspaced between the outermost abrasive material of abrasive surface 29. For example, the shape of the cavities may be selected from among a number of geometric shapes such as a cubic, cylindrical, prismatic, hemispherical, rectangular, pyramidal, truncated pyramidal, conical, truncated conical, cross, post-like with a bottom surface which is arcuate or flat, or combinations thereof. Alternatively, some or all of the cavities may have an irregular shape. In various embodiments, one or more of the side or inner walls that form the cavities may be perpendicular relative to the top major surface or, alternatively, may be tapered in either direction (i.e., tapered toward the bottom of the cavity or toward the top of the cavity—toward the major surface). The angle forming the taper can range from about 1 to 75 degrees, from about 2 to 50 degrees, from about 3 to 35 degrees, or from between about 5 to 15 degrees. The height, or depth, of the cavities can be at least 1 micron, at least 10 micron, or at least 500 micron, or at least 1000 micron; less than 10 mm, less than 5 mm, or less than 1 mm. The height of the cavities may be the same, or one or more of the cavities may have a height that is different than any number of other cavities. In some embodiments, the cavities can be provided in an arrangement in which the cavities are in aligned rows and columns. In some instances, one or more rows of cavities can be directly aligned with an adjacent row of cavities. Alternatively, one or more rows of cavities can be offset from an adjacent row of cavities. In further embodiments, the cavities can be arranged in a spiral, helix, corkscrew, or lattice fashion. In still further embodiments, the composites can be deployed in a "random" array (i.e., not in an organized pattern).

In some embodiments, the microstructured surface of contact surface 70 includes a plurality of precisely shaped abrasive composites. "Precisely shaped abrasive composite" refers to an abrasive composite having a molded shape that is the inverse of the mold cavity which is retained after the composite has been removed from the mold; preferably, the composite is substantially free of abrasive particles protruding beyond the exposed surfaces of the shape before the abrasive article has been used, as described in U.S. Pat. No. 5,152,917 (Pieper et al.), which is incorporate herein by reference in its entirety. The plurality of precisely shaped abrasive composites may include a combination of abrasive particles and resin/binder forming a fixed abrasive. In some embodiments, contact surface 70 may be formed as a two-dimensional abrasive material, such as an abrasive sheet with a layer of abrasive particles held to a backing by one or more resin or other binder layers. Alternatively, contact surface 70 may be formed as a three-dimensional abrasive material, such as a resin or other binder layer that contains abrasive particles dispersed therein and is formed into a three-dimensional structure (forming a microstructured surface) via a molding or embossing process, for example, followed by curing, crosslinking, and/or crystallizing of the resin to solidify and maintain the three-dimensional structure. The three-dimensional structure may include a plurality of precisely shaped abrasive composites. In either embodiment, contact surface 70 may include an abrasive composite which has appropriate height to allow for the abrasive composite to wear during use and/or dressing to expose a fresh layer of abrasive particles. The abrasive article may comprise a three-dimensional, textured, flexible, fixed abrasive construction including a plurality of precisely shaped abrasive composites. The precisely shaped abrasive composites may be arranged in an array to form the three-dimensional, textured, flexible, fixed abrasive construction. The abrasive article may comprise abrasive constructions that are patterned. Abrasive articles available under the trade designation TRIZACT patterned abrasive and TRIZACT diamond tile abrasives available from 3M Company, St. Paul, Minnesota, are exemplary patterned abrasives. Patterned abrasive articles include monolithic rows of abrasive composites precisely aligned and manufactured from a die, mold, or other techniques.

The shape of each precisely shaped abrasive composite may be selected for the particular application (e.g., workpiece material, working surface shape, contact surface shape, temperature, resin material). The shape of each precisely shaped abrasive composite may be any useful shape, e.g., cubic, cylindrical, prismatic, right parallelepiped, pyramidal, truncated pyramidal, conical, hemispherical, truncated conical, cross, or post-like sections with a distal end. Composite pyramids may, for instance, have three, four sides, five sides, or six sides. The cross-sectional shape of the abrasive composite at the base may differ from the cross-sectional shape at the distal end. The transition between these shapes may be smooth and continuous or may occur in discrete steps. The precisely shaped abrasive composites may also have a mixture of different shapes. The precisely shaped abrasive composites may be arranged in rows, spiral, helix, or lattice fashion, or may be randomly placed. The precisely shaped abrasive composites may be arranged in a design meant to guide fluid flow and/or facilitate swarf removal.

The precisely shaped abrasive composites may be set out in a predetermined pattern or at a predetermined location within the abrasive article. For example, when the abrasive article is made by providing an abrasive/resin slurry or abrasive/resin precursor slurry between a backing and mold, the predetermined pattern of the precisely shaped abrasive composites will correspond to the pattern of the mold, once the abrasive/resin slurry or abrasive/resin precursor is solidified. A resin precursor may be solidified, for example, by curing the resin precursor. A resin may be solidified, for example, by cooling, assuming it is being processed above its glass transition temperature and melting temperature, if it is a resin capable of crystalizing. The pattern is thus reproducible from abrasive article to abrasive article. The predetermined patterns may be in an array or arrangement, by which is meant that the composites are in a designed array such as aligned rows and columns, or alternating offset rows and columns. In another example, the abrasive composites may be set out in a "random" array or pattern. By this is meant that the composites are not in a regular array of rows and columns as described above. It is understood, however, that this "random" array is a predetermined pattern in that the location of the precisely shaped abrasive composites is predetermined and corresponds to the mold.

The abrasive articles of the present disclosure may include an abrasive material. An abrasive material forming contact surface 70 may include a polymeric material, such as a resin, e.g. a cured resin precursor. In some embodiments, the resin may include a cured or curable organic material. The method of curing is not critical, and may include, for instance, curing via energy such as actinic radiation, e.g. UV light, or heat. Examples of suitable resins/resin precursors include, for instance, amino resins, alkylated urea-formaldehyde resins, melamine-formaldehyde resins, alkylated benzoguanamine-formaldehyde resins, acrylate resins (including acrylates and methacrylates), phenolic resins, urethane resins, and epoxy resins.

Examples of suitable abrasive particles for the abrasive material include cubic boron nitride, fused aluminum oxide, ceramic aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, alumina zirconia, iron oxide, ceria, garnet, fused alumina zirconia, alumina-based sol gel derived abrasive particles and the like. The alumina abrasive particle may contain a metal oxide modifier. The diamond and cubic boron nitride abrasive particles may be mono crystalline or polycrystalline. Other examples of suitable inorganic abrasive particles include silica, iron oxide, chromia, ceria, zirconia, titania, tin oxide, gamma, alumina, and the like. The abrasive particles may be abrasive agglomerate particles. Abrasive agglomerate particles typically comprise a plurality of abrasive particles, a binder, and optional additives. The binder may be organic and/or inorganic. Abrasive agglomerates may be randomly shape or have a predetermined shape associated with them.

In some embodiments, the abrasive material, including resin, abrasive particles, and any additional additives dispersed in the resin (i.e. an abrasive composite material), may be a coating on first layer 64. In some particular embodiments, an abrasive material may be deposited on a base layer, the base layer may include a primer layer between the abrasive material and the base layer. The base layer itself may be positioned over a compliant layer, such as first layer 64 and second layer 66, with an adhesive securing the base layer to the complaint layer. The combined abrasive material coating, base layer, and first and second layers 64, 66 may then be applied to core region 68 in order to form the shape of contact surface 70 on the rotary tool.

Figure 3:
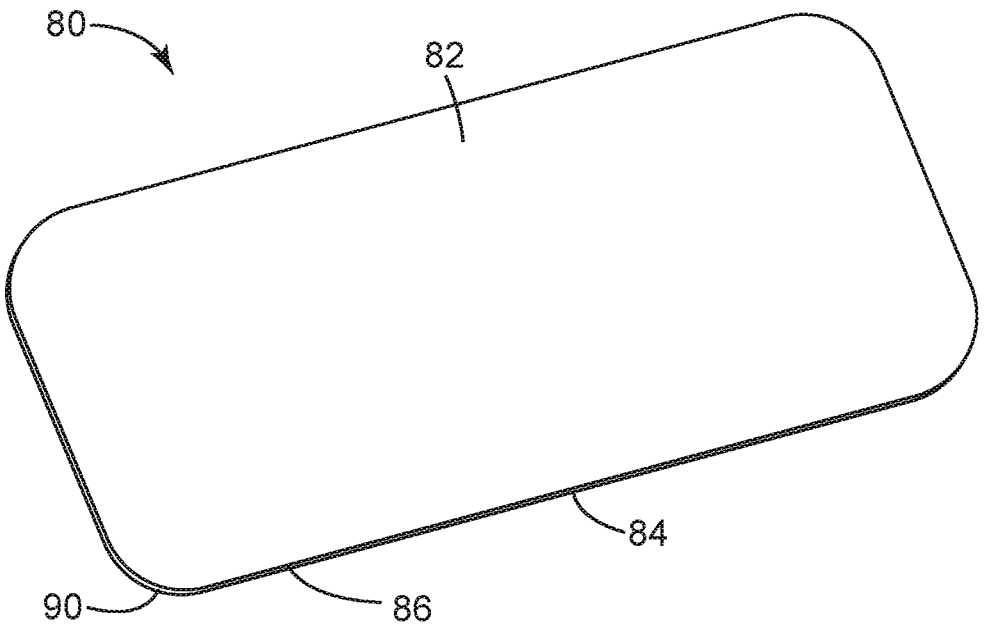
FIG. 3 illustrates a cover glass for an electronic component.

In various embodiments, abrasive articles as described herein may be used to form a contact surface of an abrasive rotary tool particularly suitable for edge grinding cover glass. FIG. 3 illustrates cover glass 80, which is a cover glass for an electronic device such as a cellular phone, personal music player, or other electronic device. In some embodiments, cover glass 80 may be a component of a touchscreen for the electronic device. Cover glass 80 may be an aluminasilicate based glass with a thickness of less than 1 mm, although other compositions are also possible, such as a thickness of less than 5 mm, less than 4 mm, less than 3 mm or even less than 2 mm.

Cover glass 80 includes a first major surface 82 opposing a second major surface 84. Generally, but not always, major surfaces 82, 84 are planar surfaces. Edge surface 86 follows the perimeter of major surfaces 82, 84, the perimeter including rounded corners 90. Edge surface 86 intersects first major surface 82 at a first corner and second major surface 84 at a second corner, the first and second corners, generally, extends around the entire perimeter of the substrate.

To provide an increased resistance to cracking and improved appearance, the surfaces of cover glass 80, including major surfaces 82, 84 and edge surface 86 should be smoothed to the extent practical during manufacturing of cover glass 80. In addition, as disclosed herein, rotary tools having abrasive articles (e.g. abrasive articles having a fine grade abrasive particle), such as those described with respect to FIG. 2, may be used to reduce edge surface roughness, such as edge surface 86 and corners of edge surface 86 formed at the intersection of major surfaces 82, 84, using a CNC machine prior to polishing via an abrasive article having a polishing grade abrasive particle. The intermediate grinding step may reduce polishing time of the polishing step that provides the desired surface finish qualities of cover glass 80, which may not only reduce production time, but may also provide more precise dimensional control for the production of cover glass 80. The particle size of the fine grade abrasive particle may be greater than the particle size of the polishing grade abrasive particle.

Figure 4A:
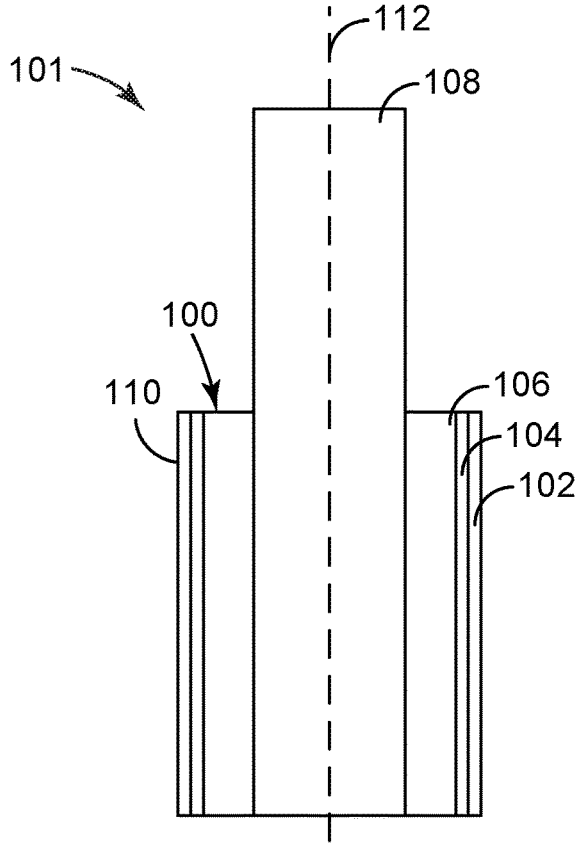
FIG. 4A illustrates a side view cross-sectional diagram of an abrasive rotary tool for abrading a substrate.

FIG. 4A illustrates a side view cross-sectional perspective of an abrasive rotary tool 101 for abrading a substrate. Abrasive rotary tool 101 includes an abrasive article 100 coupled to a tool shank 108. Abrasive article 100 includes abrasive layer 102, first layer 104, and second layer 106. Components of abrasive rotary tool 101 may be similar to components of abrasive article 60 of FIG. 2. For example, abrasive layer 102, first layer 104, and second layer 106 may be similar to or the same as abrasive layer 62, first layer 64, and second layer 66. Abrasive rotary tool 110 is configured to rotate around an axis of rotation 112. Abrasive layer 102 includes a contact surface 110 facing away from tool shank 108. A plane of contact surface 110 is parallel to axis of rotation 112.

Figure 4B:
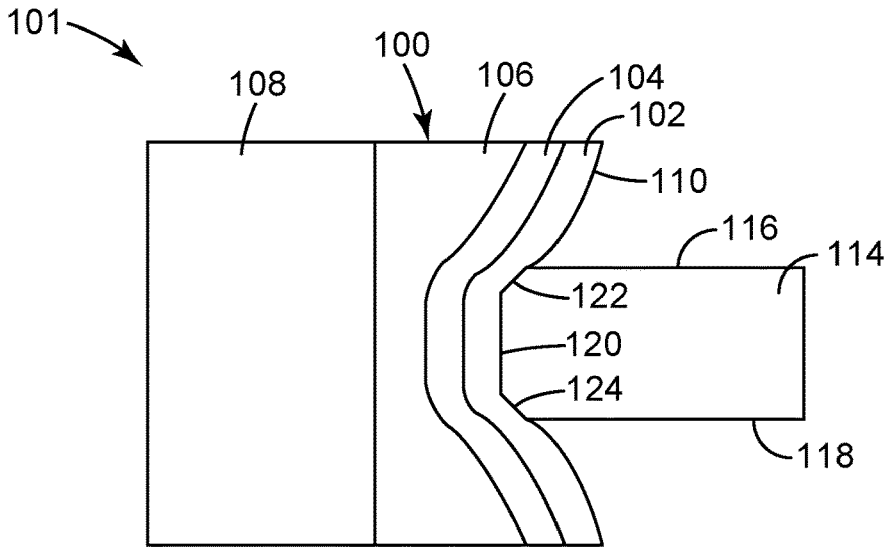
FIG. 4B illustrates a side view cross-sectional diagram of a portion of an abrasive rotary tool abrading a substrate.

FIG. 4B illustrates a cross-sectional perspective of a portion of abrasive rotary tool 101 abrading a substrate 114. Substrate 114 includes a first major surface 116, a second major surface 118, and an edge surface 120. Edge surface 120 intersects first major surface 116 to form a first corner 122 and intersects second major surface 116 to form a second corner 124. As shown in FIG. 4B, first layer 104 and second layer 106 are configured to substantially conform contact surface 110 of abrasive layer 102 to edge 120 and optionally, at least one of first corner 122 and second corner 124 of substrate 114. For example, contact surface 110 may contact both of a portion of first corner 122 and a portion of second corner 124, as well as a portion of first major surface 116 and a portion of second major surface 118. As such, during operation of abrasive rotary tool 101, contact surface 110 may simultaneously abrade the edge, a portion of first corner 122, a portion of first major surface 116, a portion of second corner 124 or a portion of second major surface 118, or any combination thereof.

Figure 5A:
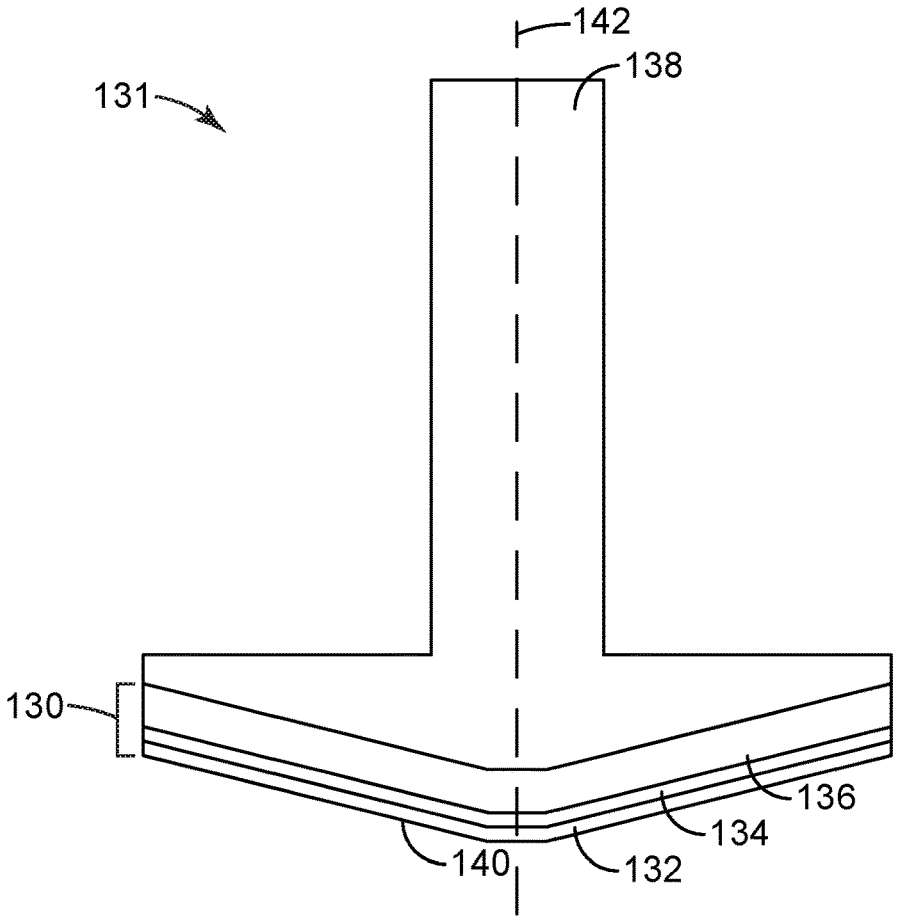
FIG. 5A illustrates a side view cross-sectional diagram of an abrasive rotary tool for abrading a substrate.

FIG. 5A illustrates a side view cross-sectional perspective of an abrasive rotary tool 131 for abrading a substrate. Abrasive rotary tool 131 includes an abrasive article 130 coupled to a tool shank 138. Abrasive article 130 includes abrasive layer 132, first layer 134, and second layer 136. Components of abrasive rotary tool 131 may be similar to components of abrasive article 60 of FIG. 2. For example, abrasive layer 132, first layer 134, and second layer 136 may be similar to or the same as abrasive layer 62, first layer 64, and second layer 66. Abrasive rotary tool 131 is configured to rotate around an axis of rotation 142. Abrasive layer 132 includes a contact surface 140 facing away from tool shank 138. In the example of FIG. 5A, a contact surface 140 is not parallel to axis of rotation 142, but rather is at an included angle between a plane of contact surface 140 and axis of rotation 142. In some embodiments, the included angle may be between about 5 degrees and about 90 degrees. By having contact surface 140 non-parallel with axis of rotation 142, contact surface 140 may be configured to abrade a variety of different surfaces at different angles.

The dimensions of the shank are not particularly limited; the shank being designed to facilitate mounting of the abrasive tools, e.g. abrasive rotary tools, of the present disclosure in the rotatable chuck of a machining apparatus, e.g. a CNC machine. The material of the tool shank may include at least one of a thermoplastic and metal, e.g. steel, stainless steel, aluminum, and the like. The shape of the shank is not particularly limited. The shank me be cylindrical in shape, having a uniform diameter or may be cylindrical in shape having two or more uniform diameters. For example, the shank may be fabricated to include a cylindrical shaped section having a diameter of less than or equal to 10 mm, less than or equal to 8 mm or even less than or equal to 6 mm and may have a second cylindrical shaped section having a diameter of greater than or equal to 15 mm, greater than or equal to 20 mm or even greater than or equal to 25 mm. The smaller diameter cylindrical region may be termed a stem and the larger diameter cylindrical region may be termed a body. In some embodiments, the shank may include a cylindrical shaped region and a conical shaped or truncated conical shaped region. The diameter of the cylindrical shaped region may be less than the maximum diameter of the conical shaped region.

Figure 5B:
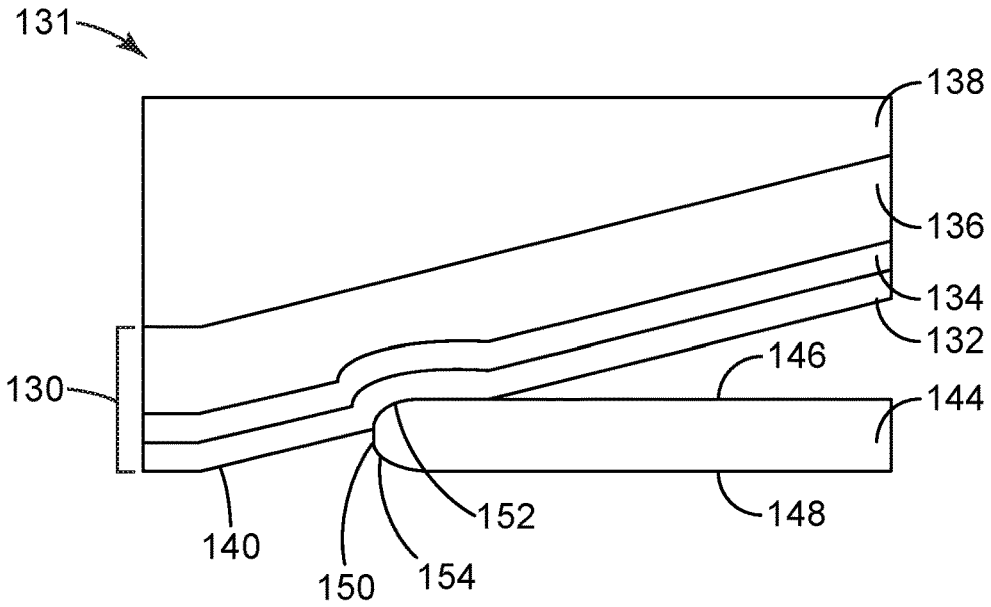
FIG. 5B illustrates a side view cross-sectional diagram of a portion of an abrasive rotary tool abrading a substrate.

FIG. 5B illustrates a cross-sectional perspective of a portion of abrasive rotary tool 131 abrading a substrate 144. Substrate 144 includes a first major surface 146, a second major surface 148, and an edge surface 150. Edge surface 150 intersects first major surface 146 to form a curved first corner 152 and intersects second major surface 148 to form a curved second corner 154. In the example of FIG. 5B, substrate 144 may be at an intermediate level of abrading, such that first and second corner 152, 154 may have been abraded to rounded corners from sharp corners, such as first corner 122 and second corner 124 shown in FIG. 4B. As shown in FIG. 5B, first layer 134 and second layer 136 are configured to substantially conform contact surface 140 of abrasive layer 132 to at least one of first corner 152 and second corner 154 of substrate 144. For example, contact surface 140 contacts a portion of first major surface 146, a portion of first corner 152 and, optionally, a portion of edge surface 150. As such, during operation of abrasive rotary tool 131, contact surface 140 may simultaneously abrade a portion of first corner 152, a portion of first major surface 146, and, optionally, a portion of edge surface 150.

Figure 6:
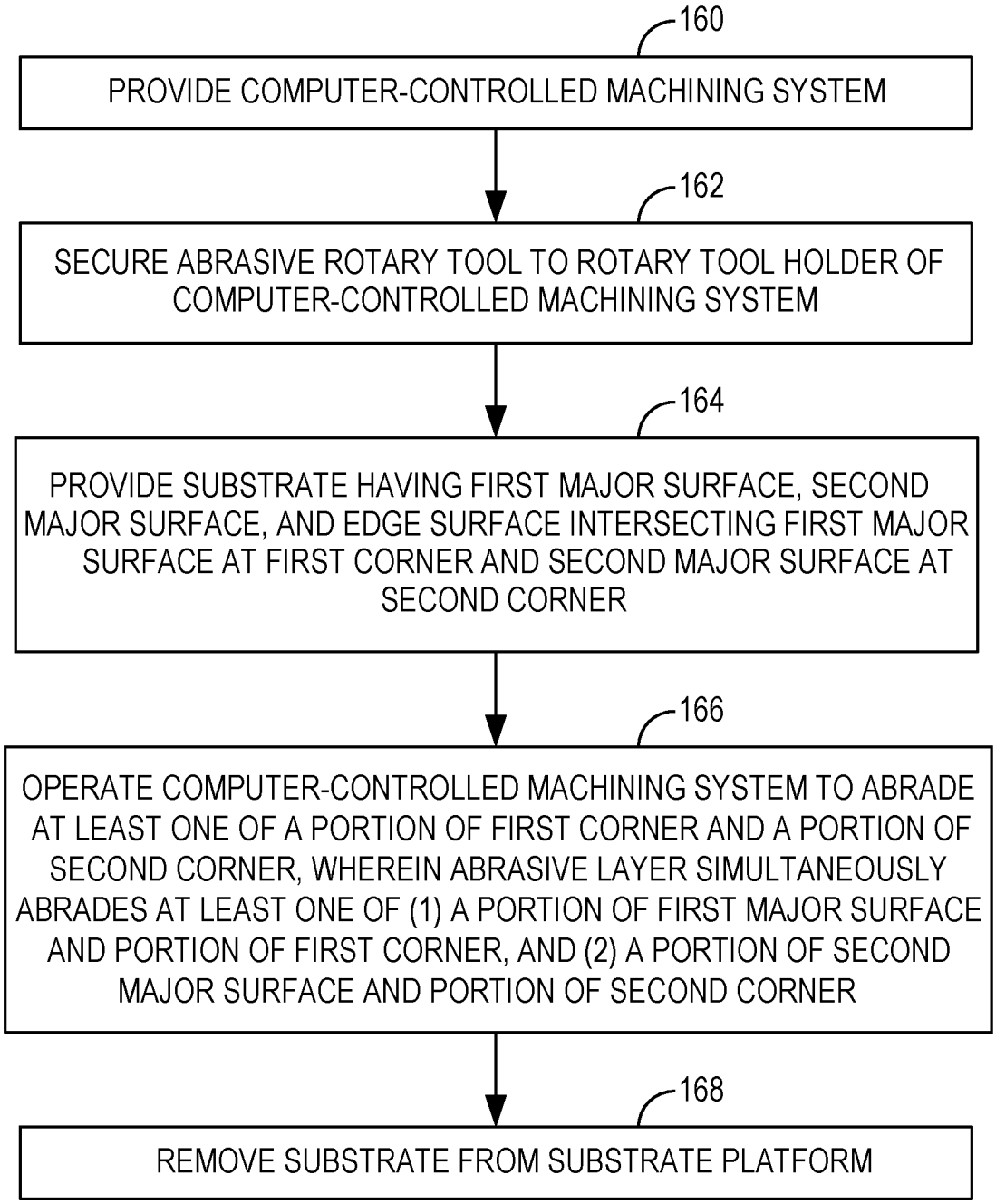
FIG. 6 is a flowchart illustrating example techniques for abrading a substrate.

FIG. 6 is a flowchart illustrating example techniques for abrading a substrate. While the techniques of FIG. 6 will be described with reference to an operator manipulating assembly 10 of FIG. 1A, other assemblies and agents of operation may be used. The operator provides computer-controlled machining system 12, which includes computer controlled rotary tool holder 20 and substrate platform 22 (160). The operator secures an abrasive rotary tool, such as rotary tool 18 of FIG. 1B, to rotary tool holder 20 of computer-controlled machining system 12 (162). The operator provides substrate 16 having a first major surface, a second major surface, and an edge surface, the edge surface intersecting the first major surface to form a first corner and the edge surface intersecting the second major surface to form a second corner (164).

The operator operates computer-controlled machining system 12, such as through controller 14, to abrade at least one of (1) a portion of the first corner and (2) a portion of the second corner of substrate 16 with abrasive article 26 of the abrasive rotary tool 18. In this way, abrasive article 26 of abrasive rotary tool 18 simultaneously abrades at least one of (1) a portion of the first corner and a portion of the first major surface, and (2) a portion of the second corner and a portion of second major surface (166). For example, in embodiments where the operator intends to abrade the portion of the first corner, the operator may operate computer-controlled machining system 12 to abrade a portion of the edge surface, a portion of the first major surface, and a portion of the first corner, such that the resulting abraded first corner is smoother. In some embodiments, at least one of the first corner and second corner is at least one of a chamfered corner and a curved corner. The abrasive layer of the abrasive rotary tool may then abrade the at least one of a chamfered corner and curved corner of the substrate. In some embodiments, substrate 16 is stationary and the rotational axis of abrasive rotary tool 18 is perpendicular to a plane of the substrate. For example, abrasive article 26 of abrasive rotary tool 18 may contact the edge surface, a portion of the first corner, a portion of the second corner, and portions of the first and second major surfaces to simultaneously abrade both the first corner and the second corner, thereby reducing abrading time.

In the embodiments of FIG. 6, the operator may continue to operate computer-controlled machining system 12 to abrade other portions of substrate 16, such as the first major surface and the second major surface, such that substrate 16 may remain fixed to substrate holding fixture 24 until other surfaces are abraded. The operator may remove the substrate from the substrate platform (168).

In another embodiment, the present disclosure provides a method of abrading a substrate which includes a multi-step process that includes two or more abrasive tools to abrade the substrate. The method utilizes a single, computer-controlled machining system and the abrasive tools may be used sequentially. The abrasive tools typically have different abrading characteristics, i.e. the abrasive layer of each abrasive tool has different abrading characteristics, resulting in a higher removal rate step followed by a lower removal rate step, the lower removal rate step may provide a substrate surface roughness that is lower than the substrate surface roughness after the high removal rate step. The abrading characteristic of the tool may be adjusted by techniques known in the art, including adjusting the mineral type and/or particle size (grain size). The substrate being abraded may be maintained in the computer controlled machining system during the process, while changing the abrasive tool and/or corresponding abrading parameters. Maintaining the substrate in the tool, improves efficiency, as the substrate does not have to be removed from the machine, remounted and its position re-registered in a second machine that would then apply the second abrading step. In one embodiment the present disclosure provides a method of abrading a substrate including providing a computer-controlled machining system; securing a first abrasive rotary tool, for example a first abrasive rotary tool according to any one of the embodiments of the present disclosure, to a rotary tool holder of the computer-controlled machining system; providing a substrate having an edge surface, for example a substrate according to any one of the substrates of the present disclosure, and securing the substrate into a substrate holder of the computer-controlled machining system; operating the computer-controlled machining system to abrade at least a portion of the edge surface of the substrate with the first abrasive rotary tool; removing the first rotary abrasive tool from the rotary tool holder; securing a second abrasive rotary tool, for example a second abrasive rotary tool according to any one of the embodiments of the present disclosure, to a rotary tool holder of the computer-controlled machining system; operating the computer-controlled machining system to abrade at least a portion of the edge surface of the substrate with the second abrasive rotary tool, wherein the substrate is not removed from the computer-controlled machining system prior to abrading at least a portion of the edge surface of the substrate with the second abrasive rotary tool. In some embodiments, the surface finish of the substrate edge after operating the computer-controlled machining system to abrade at least a portion of the edge surface of the substrate with the first abrasive rotary tool is greater than the surface finish of the substrate edge after operating the computer-controlled machining system to abrade at least a portion of the edge surface of the substrate with the second abrasive rotary tool. The method may optionally include removing the second rotary abrasive tool from the rotary tool holder; securing a third abrasive rotary tool, for example a third abrasive rotary tool according to any one of the embodiments of the present disclosure, to the rotary tool holder of the computer-controlled machining system; operating the computer-controlled machining system to abrade at least a portion of the edge surface of the substrate with the third abrasive rotary tool, wherein the substrate is not removed from the computer-controlled machining system prior to abrading at least a portion of the edge surface of the substrate with the third abrasive rotary tool. In some embodiments, the surface finish of the substrate edge after operating the computer-controlled machining system to abrade at least a portion of the edge surface of the substrate with the second abrasive rotary tool is greater than the surface finish of the substrate edge after operating the computer-controlled machining system to abrade at least a portion of the edge surface of the substrate with the third abrasive rotary tool.

Select embodiments of the present disclosure include, but are not limited to, the following:

In a first embodiment, the present disclosure provides an abrasive article, comprising:

an abrasive layer having a contact surface;

a first layer coupled to the abrasive layer, wherein the first layer has a Shore A hardness of no greater than 80; and a second layer coupled to the first layer, wherein a Shore A hardness of the second layer is less than the Shore A hardness of the first layer.

In a second embodiment, the present disclosure provides an abrasive article according to the first embodiment, wherein the hardness of the second layer is less than 50 Shore A hardness.

In a third embodiment, the present disclosure provides an abrasive article according to the first or second embodiment, wherein a ratio of the Shore A hardness of the first layer to the Shore A hardness of the second layer is greater than 1 and less than 8.

In a fourth embodiment, the present disclosure provides an abrasive article according to any one of the first through third embodiments, wherein the first layer has a first thickness and the second layer has a second thickness that is greater than the first thickness.

In a fifth embodiment, the present disclosure provides an abrasive article according to the fourth embodiment, wherein the first thickness is less than 3 mm.

In a sixth embodiment, the present disclosure provides an abrasive article according to the fourth or fifth embodiment, wherein a ratio of the first thickness to the second thickness is less than 0.75.

In a seventh embodiment, the present disclosure provides an abrasive article according to any one of the first through sixth embodiments, wherein the first layer comprises at least one of an elastomer, a fabric, or a nonwoven material.

In an eighth embodiment, the present disclosure provides an abrasive article according to any one of the first through seventh embodiments, wherein the second layer comprises at least one of a foam, an engraved, structured, 3D printed, or embossed elastomer, a fabric or nonwoven layer, or a rubber having a Shore A hardness less than 50.

In a ninth embodiment, the present disclosure provides an abrasive article according to any one of the first through eighth embodiments further comprising an adhesive disposed between the abrasive layer and the first layer.

In a tenth embodiment, the present disclosure provides an abrasive article according to any one of the first through ninth embodiments further comprising an adhesive disposed between the first layer and the second layer.

In an eleventh embodiment, the present disclosure provides an abrasive article according to any one of the first through tenth embodiments, wherein the contact surface of the abrasive layer includes a microstructured surface.

In a twelfth embodiment, the present disclosure provides an abrasive article according to any one of the first through eleventh embodiments, wherein the contact surface comprises a plurality of precisely shaped abrasive composites.

In a thirteenth embodiment, the present disclosure provides an abrasive article according to any one of the first through twelfth embodiments, wherein at least one of the first layer and second layer has a relaxation modulus of less than 25%.

In a fourteenth embodiment, the present disclosure provides an abrasive article according to any one of the first through thirteenth embodiments, wherein the first layer and the second layer are configured to substantially conform the contact surface of the abrasive layer to at least one of a first corner and second corner of a substrate, wherein the substrate includes a first major surface, a second major surface and an edge surface, the edge surface intersecting the first major surface to form the first corner, the edge surface intersecting the second major surface to form the second corner and the thickness of the edge surface measured normal to the first and second major surfaces is no greater 5 mm.

In a fifteenth embodiment, the present disclosure provides an abrasive article according to the fourteenth embodiment, wherein at least one of the first corner and second corner includes at least one of a chamfered corner and curved corner.

In a sixteenth embodiment, the present disclosure provides an abrasive article comprising:

an abrasive layer having a contact surface;

a first layer coupled to the abrasive layer; and a second layer coupled to the first layer, wherein the second layer has a compressibility at 25% deflection of no greater than 1.5 MPa and the compressibility at 25% deflection of the first layer is greater than the compressibility at 25% deflection of the second layer.

In a seventeenth embodiment, the present disclosure provides an abrasive article according to the sixteenth embodiment, wherein the compressibility at 25% deflection of the second layer is less than 1.1 MPa.

In an eighteenth embodiment, the present disclosure provides an abrasive article according to the sixteenth or seventeenth embodiment, wherein a ratio of the compressibility at 25% deflection of the first layer to the compressibility at 25% deflection of the second layer is greater than 1 and less than 200, optionally, less 150, less than 100, less than 50, less than 20 or even less than 10.

In a nineteenth embodiment, the present disclosure provides an abrasive article according to any one of the sixteenth through eighteenth embodiments, wherein the first layer has a first thickness and the second layer has a second thickness that is greater than the first thickness.

In a twentieth embodiment, the present disclosure provides an abrasive article according to the nineteenth embodiment, wherein the first thickness is less than 3 mm.

In a twenty-first embodiment, the present disclosure provides an abrasive article according to the nineteenth or twentieth embodiment, wherein a ratio of the first thickness to the second thickness is less than 0.75.

In a twenty-second embodiment, the present disclosure provides an abrasive article according to any one of the sixteenth through twenty-first embodiments, wherein the first layer comprises at least one of an elastomer, a fabric, or a nonwoven material In a twenty-third embodiment, the present disclosure provides an abrasive article according to any one of the sixteenth through twenty-second embodiments, wherein the second layer comprises at least one of a foam, an engraved, structured, 3D printed, or embossed elastomer, a fabric or nonwoven layer, or a rubber having a Shore A hardness less than 50.

In a twenty-fourth embodiment, the present disclosure provides an abrasive article according to any one of the sixteenth through twenty-third embodiments further comprising an adhesive disposed between the abrasive layer and the first layer.

In a twenty-fifth embodiment, the present disclosure provides an abrasive article according to any one of the sixteenth through twenty-fourth embodiments further comprising an adhesive disposed between the first layer and the second layer.

In a twenty-sixth embodiment, the present disclosure provides an abrasive article according to any one of the sixteenth through twenty-fifth embodiments, wherein the contact surface of the abrasive layer includes a microstructured surface.

In a twenty-seventh embodiment, the present disclosure provides an abrasive article according to any one of the sixteenth through twenty-sixth embodiments, wherein the contact surface comprises a plurality of precisely shaped abrasive composites In a twenty-eighth embodiment, the present disclosure provides an abrasive article according to any one of the sixteenth through twenty-seventh embodiments, wherein at least one of the first layer and second layer has a relaxation modulus of less than 25%.

In a twenty-ninth embodiment, the present disclosure provides an abrasive article according to any one of the sixteenth through twenty-eighth embodiments, wherein the first layer and the second layer are configured to substantially conform the contact surface of the abrasive layer to at least one of a first corner and second corner of a substrate, wherein the substrate includes a first major surface, a second major surface and an edge surface, the edge surface intersecting the first major surface to form the first corner, the edge surface intersecting the second major surface to form the second corner and the thickness of the edge surface measured normal to the first and second major surfaces is no greater 5 mm.

In a thirtieth embodiment, the present disclosure provides an abrasive article according to the twenty-ninth embodiment, wherein at least one of the first corner and second corner includes at least one of a chamfered corner and curved corner.

In a thirty-first embodiment, the present disclosure provides an abrasive rotary tool, comprising:

a tool shank defining an axis of rotation for the rotary tool; and the abrasive article of any one of embodiments 1 to 30 coupled to the tool shank, the contact surface of the abrasive article facing away from the tool shank.

In a thirty-second embodiment, the present disclosure provides an abrasive rotary tool according to the thirty-first embodiment, wherein the contact surface of the abrasive article is parallel to the axis of rotation of the rotary tool.

In a thirty-third embodiment, the present disclosure provides an abrasive rotary tool according to the thirty-first embodiment, wherein the included angle between contact surface of the abrasive article and the axis of rotation is between 5 degrees and 90 degrees.

In a thirty-fourth embodiment, the present disclosure provides an assembly, comprising:

a computer-controlled machining system comprising a computer controlled rotary tool holder and a substrate platform;

a substrate secured to the substrate platform; and an abrasive rotary tool comprising an abrasive article of any one of embodiments 1 to 30.

In a thirty-fifth embodiment, the present disclosure provides an assembly according to the thirty-fourth embodiment, wherein the abrasive rotary tool further comprises a tool shank defining an axis of rotation for the abrasive rotary tool and wherein the abrasive article is coupled to the tool shank, wherein the contact surface of the abrasive article facing away from the tool shank.

In a thirty-sixth embodiment, the present disclosure provides an assembly according to the thirty-fifth embodiment, wherein the contact surface of the abrasive article is parallel to the axis of rotation of the rotary tool.

In a thirty-seventh embodiment, the present disclosure provides an assembly tool according to the thirty-fifth embodiment, wherein the included angle between contact surface of the abrasive article and the axis of rotation is between 5 degrees and 90 degrees.

In a thirty-eighth embodiment, the present disclosure provides an assembly tool according to any one of the thirty-fourth through thirty-seventh embodiments, wherein the substrate is a component for an electronic device.

In a thirty-ninth embodiment, the present disclosure provides an assembly tool according to the thirty-eighth embodiment, wherein the component for an electronic device is a transparent, display element.

In a fortieth embodiment, the present disclosure provides a method for polishing a substrate, comprising:

providing a computer-controlled machining system including a computer controlled rotary tool holder and a substrate platform;

securing an abrasive rotary tool of any of the thirty-first through thirty-third embodiments to the rotary tool holder of the computer-controlled machining system;

providing a substrate having a first major surface, a second major surface and an edge surface, the edge surface intersecting the first major surface to form a first corner and the edge surface intersecting the second major surface to form a second corner; and operating the computer-controlled machining system to abrade the edge and at least one of a portion of the first corner and a portion of the second corner of the substrate with the abrasive layer of the abrasive rotary tool, optionally, wherein the abrasive layer of the abrasive rotary tool simultaneously abrades the edge and at least one of a portion of the first corner and a portion of the first major surface, and a portion of the second corner and a portion of second major surface.

In a forty-first embodiment, the present disclosure provides a method for polishing a substrate according to the fortieth embodiment further comprising:

operating the computer-controlled machining system to abrade at least one of the first major surface and second major surface of the substrate; and removing the substrate from the substrate platform after operating the computer-controlled machining system to abrade at least one of the first major surface and second major surface In a forty-second embodiment, the present disclosure provides a method for polishing a substrate according to the fortieth or forty-first embodiment, wherein at least one of the first corner and second corner is at least one of a chamfered corner and a curved corner and the abrasive layer of the abrasive rotary tool abrades the at least one of a chamfered corner and curved corner of the substrate.

In a forty-third embodiment, the present disclosure provides a method for polishing a substrate according to any one of the fortieth through forty-second embodiments, wherein during operation of the computer controlled machining system, the substrate is stationary and the rotational axis of the abrasive rotary tool is perpendicular to a plane of the substrate.

EXAMPLES

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

Figure 7:
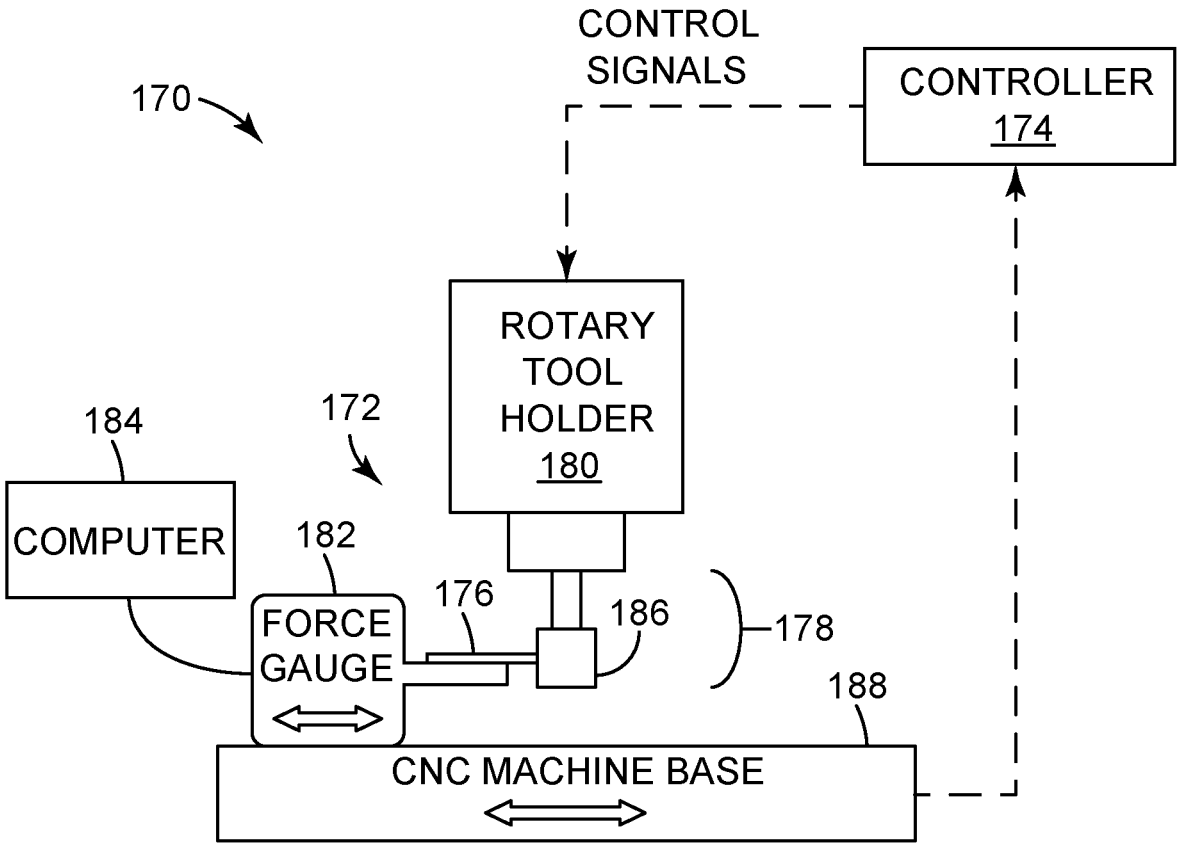
FIG. 7 illustrates a system for abrading a substrate and measuring the forces acting on the substrate.

FIG. 7 is a schematic diagram of an experimental system 170 for determining force measurements for abrasive articles 186 against substrate 176 as discussed herein. System 170 includes a CNC machine 172 and a CNC machine controller 174. Controller 174 is configured to send control signals to CNC machine 172 for causing CNC machine 172 to machine, grind, or abrade substrate 176 with a rotary tool 178, which is mounted within a rotary tool holder 180 of CNC machine 172. CNC machine 172 may be capable of performing routing, turning, drilling, milling, grinding, abrading, and/or other machining operations, and controller 174 may include a CNC controller that issues instructions to rotary tool holder 180 for performing machining, grinding, and/or abrading of substrate 176 with one or more rotary tools 178. Controller 174 may include a general purpose computer running software, and such a computer may combine with CNC controller 174 to provide the functionality of CNC controller 174. Rotary tool 178 includes abrasive article 186. Abrasive article 186 may be any one of the abrasive articles of the present disclosure.

Substrate 176 is mounted to force gauge 182 by a substrate holder (not shown) in a manner that facilitates measurement of the contact force on substrate 176 by CNC machine 172, such as through suction or other holding mechanism. Force gauge 182 is configured to measure the contact force received by the substrate 176 in one direction. Force gauge 182 may be communicatively coupled to a computer 184 configured to receive force measurements from force gauge 182. Force gauge 182 may be coupled to a CNC machine base 188 communicatively coupled to CNC machine controller 174.

Figure 8A:
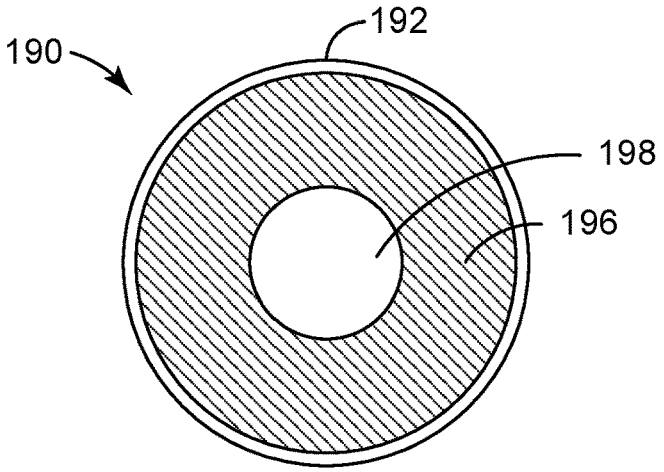
FIG. 8A illustrates a top view cross-sectional diagram of the abrasive article of Comparative Example 1.
Figure 8B:
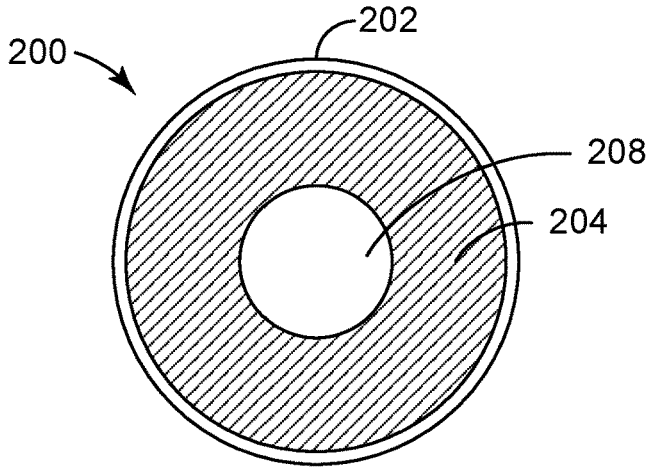
FIG. 8B illustrates a top view cross-sectional diagram of the abrasive article of Comparative Example 2.
Figure 8C:
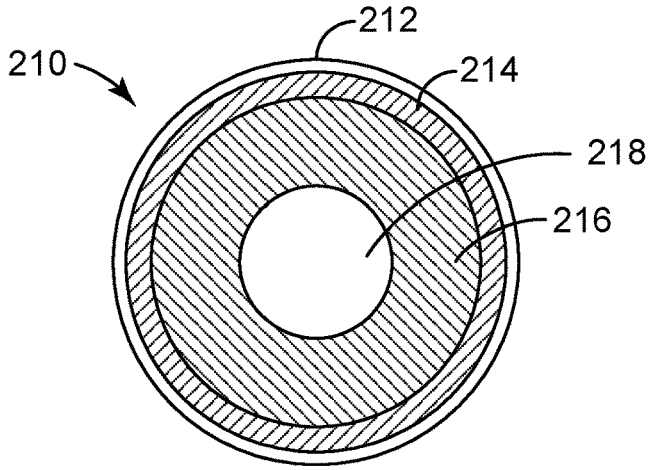
FIG. 8C illustrates a top view cross-sectional diagram of the abrasive article of Example 3.

FIGS. 8A-8C illustrate abrasive articles of Comparative Example 1, Comparative Example 2, and Example 3, respectively.

Test Methods

Shore A Hardness Test Method

Shore A hardness was measured using a Shore A durometer gauge, Model 1500, Type A, available from Rex Gauge Company, Buffalo Grove, Illinois, following the procedure of ASTM D2240, Revision 15. The rubber sample of Comparative Example 2 was tested using three stacked layers for a 7.2 mm thickness.

Compressibility Test Method

The compressibility test to determine the compressibility at 25% deflection was carried out using an MTS INSIGHT Electromechanical Testing System available from MTS Systems Corp., 14000 Technology Drive, Eden Prairie, Minnesota, following the general procedures of ASTM D3574 (for foam materials) and ASTM D575 (for rubber materials). The procedure of ASTM D575 was conducted with the following modifications: modified to less than 1 inch (2.54 cm) thick samples and modified to less than 3 samples. The rubber sample of Comparative Example 2 was tested by this modified ASTM D3574 method, with a sample being a 31 mm diameter disc having a 2.4 mm thickness with a compression rate of 0.2 mm/sec. The procedure of ASTM D3574 was conducted with the following modifications: modified to less than 1 inch (2.54 cm) thick samples and modified to less than 3 samples. The foam of Comparative Example 1 was tested by this method, with a sample being a 31 mm diameter disc having a 7.5 mm thickness with a compression rate of 0.2 mm/sec.

Comparative Example 1 includes an abrasive article 190 that includes an abrasive layer 192 and a supportive layer 196 around a core region 198, as shown in FIG. 8A. The abrasive layer is attached to the supportive layer with 3M Adhesive Transfer Tape 9472LE, available from 3M Company, St. Paul, Minnesota. Supportive layer 196 is composed of a closed-cell polyurethane foam. The foam was harvested from a PEGASUS roller, available from American Roller Corp, 1440 13th Avenue Union Grove, Wisconsin. The foam was the inner layer of a two layer compliant roller cover and had a hardness of 10 Shore A, thickness of 25 mm and a compressibility at 25% deflection of 2.4. psi (0.0165 MPa). Abrasive layer 192 is composed of 3M 578XA-TP2 TRIZACT abrasive, available from the 3M Company, St. Paul, MN. The abrasive article of Comparative Example 1 was then mounted to a shank, an aluminum shank having a 1 inch (2.54 cm) diameter body and a 6 mm diameter stem. The inner surface of the supportive layer was attached to the cylindrical surface of the shank body using 3M Adhesive Transfer Tape 9472LE, available from 3M Company.

Comparative Example 2 includes an abrasive article 200 that includes an abrasive layer 202 and a supportive layer 204 around a core region 208, as shown in FIG. 8B. The abrasive layer is attached to the supportive layer with 3M Adhesive Transfer Tape 9472LE, available form 3M Company, St. Paul, Minnesota. Supportive layer 204 is composed of a urethane rubber layer. The rubber layer was harvested from a PEGASUS roller, available from American Roller Corp, 1440 13th Avenue Union Grove, Wisconsin. The rubber layer was the outer layer of a two layer compliant roller cover and had a hardness of 60 Shore A, a thickness of 2.4 mm and a compressibility at 25% deflection of 1.5 MPa. Abrasive layer 202 is composed of 3M 578XA-TP2 TRIZACT abrasive, available from the 3M Company, St. Paul, MN. The abrasive article of Comparative Example 2 was then mounted to a shank, an aluminum shank having a 1 inch (2.54 cm) diameter body and a 6 mm diameter stem. The inner surface of the supportive layer was attached to the cylindrical surface of the shank body using 3M Adhesive Transfer Tape 9472LE, available from 3M Company.

Example 3 illustrates an example abrasive article 210 as discussed herein that includes an abrasive layer 212, a first layer 214, and a second layer 216 around a core region 218, as shown in FIG. 8C. First layer 214 is composed of the urethane rubber layer, as described in Comparative Example 2, with a hardness of 60 Shore A and thickness of 2.4 mm. Second layer 216 is composed of a closed-cell polyurethane foam layer, as described in Comparative Example 1, with a hardness of 10 Shore A and thickness of 25 mm, such that second layer 216 has a greater thickness and lower hardness than first layer 214. Abrasive layer 212 is composed of 3M 578XA-TP2 TRIZACT abrasive, available from the 3M Company, St. Paul, MN. The abrasive article of Example 3 was then mounted to a shank, an aluminum shank having a 1 inch (2.54 cm) diameter body and a 6 mm diameter stem. The inner surface of the second layer was attached to the cylindrical surface of the shank body using 3M Adhesive Transfer Tape 9472LE, available from 3M Company.

Each rotary tool was mounted to a CNC milling machine spindle and rotated at 1000 rpm. The outer surface of the tool was brought in contact with the substrate mounted on the force gauge, with the edge exposed over the edge of the mount. Water/coolant mixture was applied to the contact location. Depth of engagement, i.e. engagement depth, was increased in series of steps, the dwell time in each step was 5 seconds. Then, engagement depth was decreased in a series of steps; the dwell time in each step was also 5 seconds. For Comparative Example 1, the engagement depths were 750 microns, 1500 microns, 2250 microns, 1500 microns and 750 microns. For Comparative Example 2 and Example 3, the engagement depths were 250 microns, 500 microns, 750 microns, 500 microns and 250 microns. For soft supportive layers, e.g. supportive layer of Comparative Example 1, even large engagement depths may not produce an abrading pressure to provide a useful abrading process.

Figure 9:
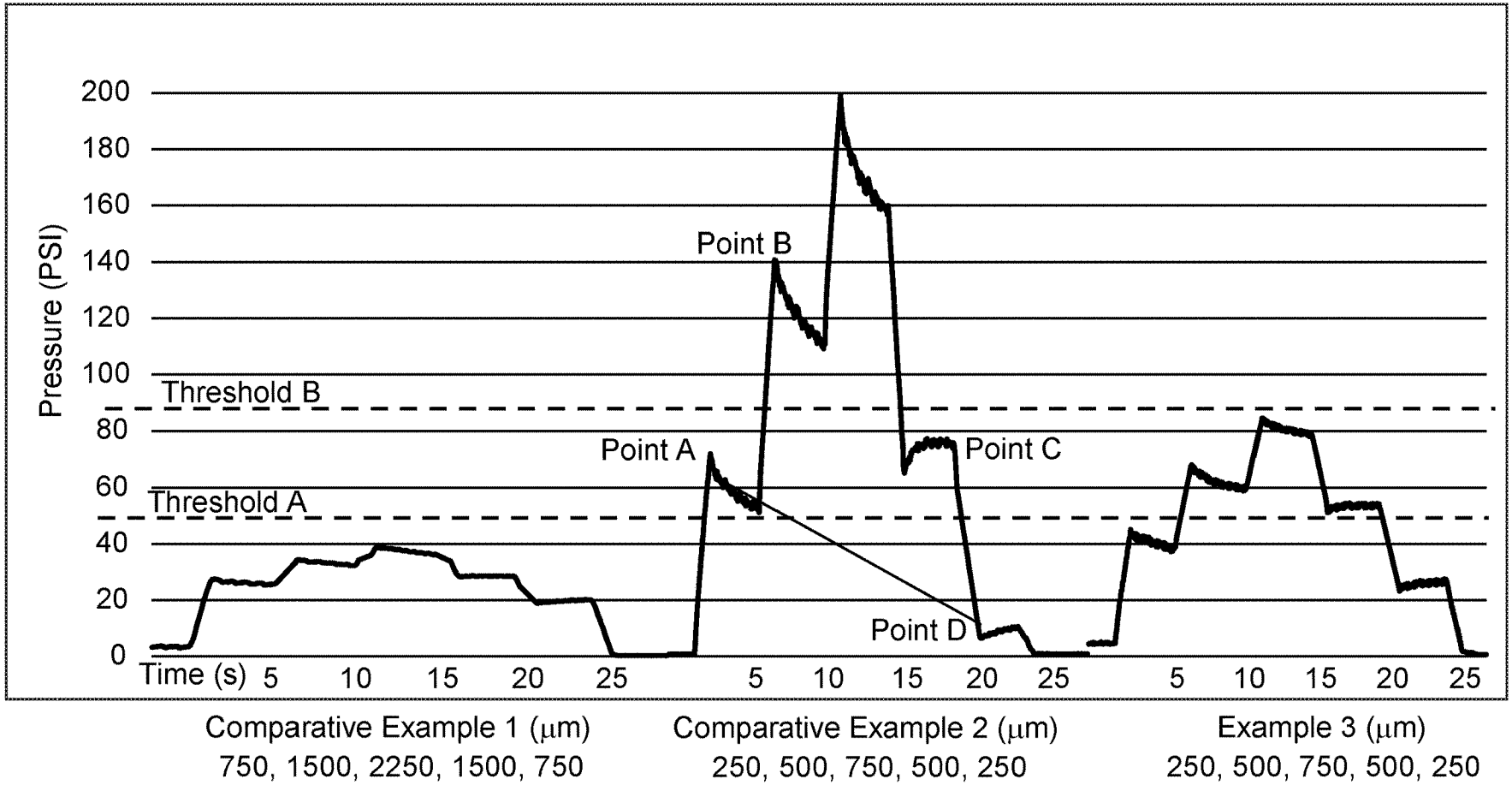
FIG. 9 illustrates an example pressure vs. time diagram of the abrasive articles of Comparative Examples 1, 2 and Example 3.

FIG. 9 illustrates example force diagrams of Comparative Example 1, Comparative Example 2, and Example 3, respectively. Each plot represents a time on an x-axis and a pressure on a y-axis. Pressure was calculated from the force applied to each respective abrasive article and the area covered was calculated from the engagement depth. Threshold A and Threshold B represent minimum and maximum thresholds, respectively, for abrading.

As seen in FIG. 9, Comparative Example 2 is not stable at the desired operating window between thresholds A and B in the graph. For example, hysteresis may be illustrated in FIG. 9 by a comparison of the difference of pressure at the engagement depth at point B on the graph compared to point C, as well as point A compared to point D. Additionally, high relaxation over just 5 seconds is shown at points A and B. Such high relaxation and hysteresis may lead to nonuniform abrading over time. Also, although the pressure measured at point A is in the target pressure range, the material relaxation is high and the pressure will drop below the threshold, causing the abrading process to be unstable and inconsistent, as shown in the line from point A to point D.

In contrast, Example 3 has improved performance, with a wide operating pressure range that is ideal for the abrasive and abrasive process. While Example 3 has been described in terms of a specific composition, such as specific properties of abrasive layer 212, first layer 214, and second layer 216, improved performance may result from a wide variety of materials as described herein.

Figure 10:
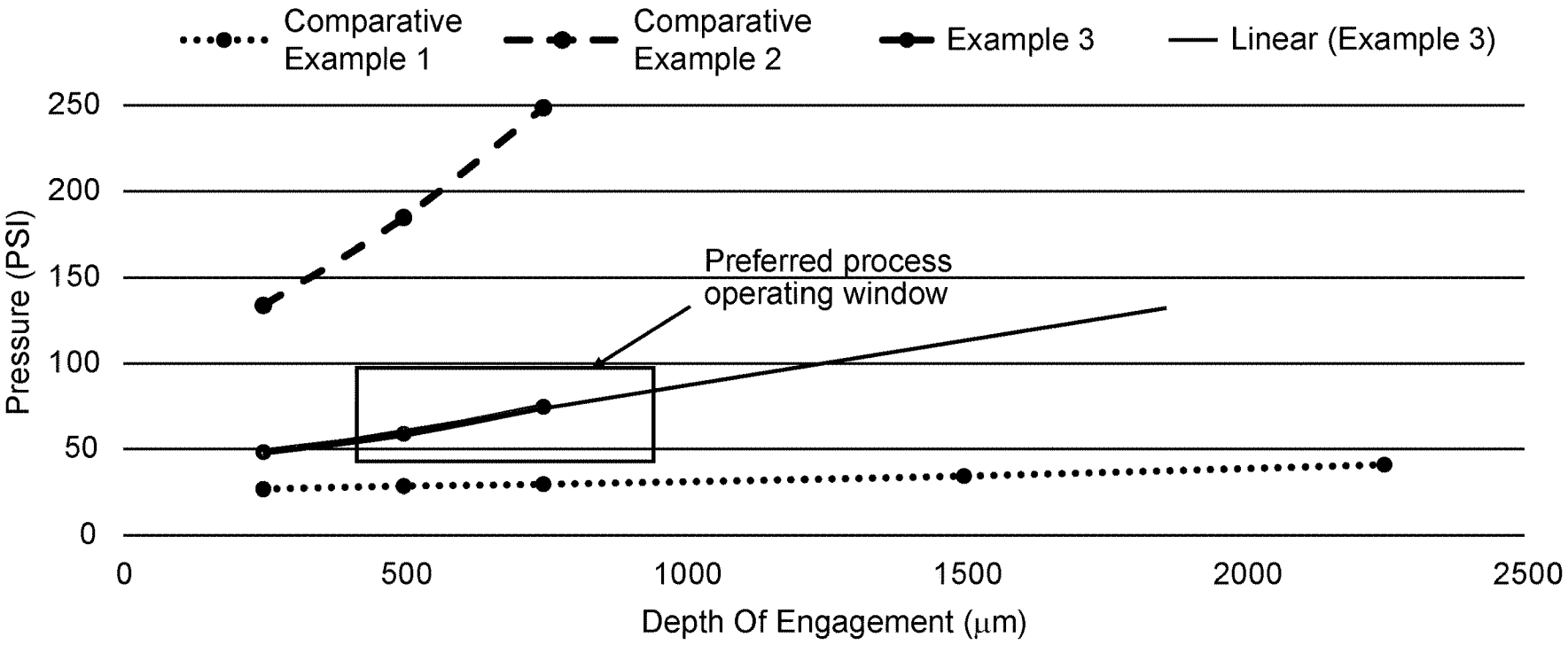
FIG. 10 illustrates an example graph of pressure vs. engagement depth of the abrasive articles of Comparative Examples 1, 2 and Example 3.

FIG. 10 illustrates examples of pressure compared to engagement depth of Comparative Example 1, Comparative Example 2, and Example 3. As shown in Comparative Example 1 of FIG. 10, an abrasive article made of one or more soft compressible foam layer(s) may not be practical in an abrading process, as it may not provide enough contact pressure to remove topology variations on substrate surfaces. Even excessive displacement of this tool type into the substrate surface may not be able to build up required pressure for the abrading process.

On the other hand, as shown in Comparative Example 2 of FIG. 10, the abrasive tool 200 with only a hard backing layer may exhibit high hysteresis, lower conformability, and/or high pressure variation, which may cause inconsistent abrading. For example, the pressure-depth of engagement curve of Comparative Example 2, having an abrasive rotary tool with only a rubber layer, is very sharp, i.e. it has a greater slope, compared to Comparative Example 1. As such, a small change in the engagement depth value, coming from tool run-out, work piece surface nonuniformity, or any other disturbance, may lead to significant change in the contact pressure, which may affect the abrading uniformity. Also, hard rubber materials often exhibit stress relaxation during deformation due to their time-dependent viscoelastic nature, which may cause inconsistent abrading.

In contrast, as shown in Example 3 of FIG. 10, the abrasive tool 210, which was made of a soft inner layer and a hard outer layer, provided controlled and consistent contact pressure needed for the abrading process. Example 3 has low hysteresis, low relaxation, good conformability, and low variation in pressure which provides a uniform surface finish, due to its contact pressure-depth of engagement relationship, as shown.

During operation of abrasive tool 310, the improved pressure vs depth of engagement may operate in a preferred process operating window. For example, if the pressure is too low, the material removal may be low. On the other hand, if the pressure is too high, the abrasive may wear out prematurely or remove too much material from the substrate in uncontrolled abrading of regions of the substrate. FIG. 10 illustrates an example of a preferred process operating window, such that the material removal rate may be both adequately consistent and adequately high.

Various embodiments of the invention have been described. These and other embodiments are within the scope of the following claims.

The invention claimed is:

1. An abrasive article, comprising:

an abrasive layer having a contact surface comprising a microstructured surface, the microstructured surface comprising a plurality of microstructures and a plurality of cavities;

a first layer coupled to the abrasive layer, wherein the first layer has a Shore A hardness of no greater than 80; and a second layer coupled to the first layer, wherein a Shore A hardness of the second layer is less than the Shore A hardness of the first layer.

2. The abrasive article of claim 1, wherein the hardness of the second layer is less than 50 Shore A hardness.

3. The abrasive article of claim 1, wherein the first layer comprises at least one of an elastomer, a fabric, or a nonwoven material.

4. The abrasive article of claim 1, wherein the second layer comprises at least one of a foam, an engraved, structured, 3D printed, or embossed elastomer, a fabric or nonwoven layer, or a rubber having a Shore A hardness less than 50.

5. The abrasive article of claim 1, wherein the first layer and the second layer are configured to substantially conform the contact surface of the abrasive layer to at least one of a first corner and second corner of a substrate, wherein the substrate includes a first major surface, a second major surface and an edge surface, the edge surface intersecting the first major surface to form the first corner, the edge surface intersecting the second major surface to form the second corner and the thickness of the edge surface measured normal to the first and second major surfaces is no greater 5 mm.

6. The abrasive article of claim 5, wherein at least one of the first corner and second corner includes at least one of a chamfered corner and curved corner.

* * * * *